US009136607B2

(12) United States Patent
Anderson

(10) Patent No.: US 9,136,607 B2
(45) Date of Patent: Sep. 15, 2015

(54) ANTENNA BEAM STEERING THROUGH WAVEGUIDE MODE MIXING

(75) Inventor: James P. Anderson, Arlington, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 573 days.

(21) Appl. No.: 13/444,669

(22) Filed: Apr. 11, 2012

(65) Prior Publication Data

US 2013/0271321 A1 Oct. 17, 2013

(51) Int. Cl.
*H01Q 3/00* (2006.01)
*H01Q 13/02* (2006.01)
*H01Q 3/36* (2006.01)

(52) U.S. Cl.
CPC ..... *H01Q 13/025* (2013.01); *H01Q 3/36* (2013.01)

(58) Field of Classification Search
CPC ..... H01Q 3/00; H01Q 13/025; H01Q 3/36
USPC ..... 342/368, 371, 361
See application file for complete search history.

(56) References Cited

U.S. PATENT DOCUMENTS

| | | | | |
|---|---|---|---|---|
| 3,909,829 | A * | 9/1975 | Daly | 342/368 |
| 5,751,248 | A * | 5/1998 | Thaniyavarn | 342/368 |
| 6,429,825 | B1 * | 8/2002 | Martek | 343/770 |
| 6,606,073 | B1 * | 8/2003 | Visser | 343/771 |
| 7,212,087 | B2 * | 5/2007 | Nagai | 333/210 |
| 2005/0099222 | A1 * | 5/2005 | Yang et al. | 327/404 |
| 2005/0239426 | A1 * | 10/2005 | Berretta et al. | 455/227 |
| 2005/0253770 | A1 * | 11/2005 | Edward et al. | 343/824 |
| 2006/0035588 | A1 * | 2/2006 | Chapelle | 455/13.3 |
| 2006/0132374 | A1 * | 6/2006 | Wang | 343/770 |
| 2006/0279373 | A1 * | 12/2006 | Keating et al. | 333/24.3 |
| 2008/0240718 | A1 * | 10/2008 | Werner et al. | 398/96 |

OTHER PUBLICATIONS

G. Gantenbein, et al., "High-power tests and analysis of a remote steering launcher mock-up for ECRH and ITER", *Transmission Lines and Antennas, Joint 30th Intl. Conf. on Infrared and Millimeter Waves & 13th Intl. Conf. on Terahertz Electronicsi, pp. 549-550 (2005 ).*

(Continued)

*Primary Examiner* — Harry Liu
(74) *Attorney, Agent, or Firm* — Hamilton, Brook, Smith & Reynolds, P.C.

(57) ABSTRACT

The present invention relates to a method of, and corresponding apparatus for, electronically steering an antenna beam. Beam steering is accomplished by altering the electric-field distribution at the open-end of one or more overmoded waveguides through the controlled mixing of multiple modes. An example method includes propagating a signal in multiple modes in a waveguide, and controlling the relative phase and amplitude of the respective modes, relative to each other, to steer the beam. A further example includes a common waveguide enabling the propagation of multiple modes, first and second waveguides enabling the propagation of respective first and second modes, a splitter/combiner coupling the first and second waveguides to the common waveguide, and a controller for controlling a propagation characteristic of the modes relative to each other in a least one path to steer the beam. Electronically steering a beam is useful for fine-tuned angle adjustments and tight beam scanning.

60 Claims, 15 Drawing Sheets

(56) References Cited

OTHER PUBLICATIONS

W. Kasparek, et al., "Performance of a Remote Sterring Antenna for ECRH/ECCD Applications Using 4-Wall Corrugated Square Waveguide", Electron Cyclotron Emission and Electron Clyclotron Heating, Proceedings for the 12$^{th}$Joint Workshop, Aix-en-Provence, France, edited by Gerardo Giruzzi, *World Scientific eProceedings*, May 13-16, 2002.

E.J. Kowalski, et al., "Linearly Polarized Modes of a Corrugated Metallic Waveguide", *IEE Transactions on Microwave Theory and Techniques*, 58(11): 2772-2780 (Nov. 2010).

K. Takahashi, et al., "High power experiments of remote steering launcher for electron cyclotron heating and current drive", *Science Direct, Fusion Engineering and Design*, 65: 589-598 (2003).

A.G.A. Verhoeven, et al., "Design of the MM-Wave System of the ITER ECRH Upper Launcher", *Toon Verhoeven*, pp. 1-3 (Jun. 28, 2004).

* cited by examiner

ANTENNA BEAM STEERING THROUGH WAVEGUIDE MODE MIXING

GOVERNMENT SUPPORT

This invention was made with government support under FA8721-05-C-002 awarded by the ESC/CAA. The government has certain rights in the invention.

BACKGROUND OF THE INVENTION

Two of the most important applications of microwave technology include microwave communications systems and radio detection and ranging (radar).

Microwave (or radio frequency (RF)) communications systems can be used to provide communications links to carry voice, data, or other signals over distances ranging from only a few meters to deep space. At a top-level, microwave communication systems can be grouped into one of two types: guided systems, where the signal is transmitted over a low loss cable or waveguide; and radio links, where the radio signal propagates through space. In a broad sense, radio link microwave communications systems and radar systems operate in a similar way and share many components.

Developed during World War II, radar is quite possibly the most prevalent application of microwave technology. In the basic operation of radar, a transmitter sends out a signal, which is partially reflected by a distant target, and then a sensitive receiver detects the partially reflected signal. If a narrow fixed beam antenna is used, the direction of the target can be accurately given by the position of the antenna beam. The distance to the target is determined by the time required for the transmitted signal to travel back to the receiver after reflecting off of the target. The radial velocity of the target can be determined from the Doppler shift of the reflected return signal. Radar systems can be used in a variety of applications, including airport surveillance, aircraft landing, marine navigation, weather radar, meteorological surveillance, speed measurement (i.e., police radar), detection and tracking of aircraft, missiles and spacecraft, missile guidance, fire control for missile and artillery, astronomy, mapping and imaging, and the remote sensing of natural resources.

An important component in radar and radio link communication systems is the antenna. An antenna is a component that converts a wave propagating on a transmission line to a wave propagating in free space (transmission), or a wave propagating in free space to a wave propagating on a transmission line (reception). A wide variety of antenna types and geometries exist, including aperture antennas, reflector antennas, phased array antennas and combinations thereof.

Aperture antennas are often flared sections of waveguide, typically referred to as a horn, or simply even an open ended waveguide. Such antennas are commonly used at microwave frequencies and have moderate antenna gains. Antennas of this type are often used for aircraft and spacecraft applications, because they can be conveniently flush mounted on the skin of the vehicle and filled with a dielectric material to provide protection to the aperture from hazardous conditions of the environment, while maintaining the aerodynamic properties of the vehicle.

Reflector antennas are typically used for applications requiring high antenna gains, such as radar systems. Usually, the high gains of such antennas are achieved by focusing the radiation from a small antenna feed onto an electrically large reflector. An antenna feed is a component of an antenna that couples electromagnetic energy (i.e., microwaves or radio waves) to a focusing component of an antenna structure, such as a reflector. In other words, for transmission, an antenna feed guides RF energy from a transmission line to a reflecting or directive structure that forms the RF energy from the antenna feed into a beam or other desired radiation pattern for propagation in free space. For reception, an antenna feed collects incoming RF energy, which is converted it into RF signals that are propagated along a transmission line to the receiver. Often, the antenna feed is a dipole, horn or even open ended waveguide. Antennas typically consist of a feed and additional reflecting or directive structures (such as a parabolic dish or parasitic elements) whose function is to form the radio waves from the feed into a beam or other desired radiation pattern.

The high gains provided by reflector antennas are useful for increasing the range of a microwave system. Reflector antennas, of which dish antennas are a specific type, are relatively easy to fabricate and are typically quite rugged. However, such antennas can be large and unwieldy to move. Because of this, robust mechanical systems are typically needed to steer reflector antennas. The directive beam of reflector antennas are typically directed along the boresight axis and steered solely by mechanical means.

Phased array antennas are comprised of multiple stationary antenna elements, typically identical, which are fed coherently and use variable phase or time delay control at each element to scan a directive beam to a given angle and space. (Variable amplitude control is often also used to provide beam pattern shaping.) Examples of typical phased array antenna elements, also called radiators, include dipoles, microstrip or patch elements. The primary advantage that a phased array antenna has over more traditional antenna types, such as aperture and reflector antennas, is that the directive beam that can be repositioned, i.e., scanned, electronically. Electronic beam steering can be useful for quickly and accurately repositioning a beam.

Hybrid antennas, such as reflector antennas with a phased array feed, combine useful characteristics of both antenna types, such as the high gain and robust design of a reflector antenna and the agile electronic capabilities of a phased array antenna. Although not typically used due to design costs outweighing the increased performance, a hybrid reflector antenna with a phased array feed can be electronically scanned over a limited angular region.

Many microwave systems, such as high-power radar systems, rely on waveguide transmission lines for the low loss transmission of microwave power. Waveguide, which is typically a rectangular or circular tube, is capable of handling high power microwave signals but is bulky and expensive. Because waveguides are comprised of a single conductor, they support transverse electric (TE) and transverse magnetic (TM) waves, which are characterized by the presence of longitudinal magnetic or electric field components, respectively.

Waveguides were one of the earliest types of transmission lines used to transport microwave signals and are still used today. Because of this, a large selection of waveguide components, such as splitters/combiners, couplers, detectors, isolators, attenuators, phase shifters and slotted lines, are commercially available for various standard waveguide bands from 1 giga-hertz (GHz) to over 220 GHz. Due to the recent trend towards miniaturization and integration, many microwave circuits are currently being fabricated using planar transmission lines, such as microstrip and stripline, instead of waveguide. However, there is still a need for waveguide in many applications that require high power, such as high-power radar and millimeter wave systems.

For the sake of design simplicity, most waveguide-based transmission line systems support only a single "fundamental" propagating mode. Although waveguide is generally considered a low-loss type of transmission line, ohmic losses can significantly limit the distance over which energy traveling in the fundamental mode can be transmitted. Due to the inverse relationship between wavelength and frequency, high-frequency waveguide components, such as millimeter wave systems, have small dimensions. In high-power systems, voltage breakdown, or arcing, can occur when the dielectric material (typically air for waveguides) separating conductors breaks down. Such arcing is more likely to occur in high-power, high-frequency systems because of the relatively small dimensions between conductors.

To avoid these limitations, particularly in applications requiring high power and high frequency signals, overmoded waveguide is useful. "Overmoded" refers to waveguide structures where the dimensions are larger than the wavelength of the transmitted signal. In such waveguide geometries, more than one propagating mode can simultaneously exist. Such waveguide geometries can be useful to significantly reduce ohmic loss by propagating a particular mode, wherein the electric and magnetic fields maximum are situated far from the walls (i.e., the conductor) of the waveguide. The power saved by avoiding ohmic loss by using overmoded waveguide can be offset by unwanted mode conversion, where power can be shifted from the intended mode to a parasitic mode. Such parasitic mode conversion typically results in power loss and reflections due to mismatch.

For highly oversized waveguide, many propagating modes can exist. One of these modes can be selected for efficient, low loss transmission in a radar transmission line. Typically, such a mode is low order and couples well with a free-space radiating beam, i.e., the low order mode is well-matched to the propagation coefficient of free-space. In such instances, the propagating mode represents the beam pattern at the feed horn which illuminates the radar's focusing antenna. Generally, the goal is to have a pure, single mode at the feed to minimize beam distortion.

SUMMARY OF THE INVENTION

An example method of steering an antenna beam includes applying a signal to one or more waveguides, the signal propagating through the one or more waveguides in multiple modes, controlling at least one propagation characteristic of those modes with respect to one another so that the electromagnetic beam of the antenna can be steered.

In accordance with another aspect of the invention that can be applied to antennas or other applications, an example method of steering an electromagnetic beam includes propagating first and second radio frequency (RF) signals, respectively propagating in a first and second mode in a first and second waveguide, and controlling the relative propagation parameters of at least one of the signals to steer the beam propagating in free-space.

In accordance with a further aspect of the invention, an example antenna feed includes one or more waveguides enabling the propagation of multiple modes coupled to an antenna, and a controller for steering the beam of to the antenna by controlling a propagation characteristic of the respective modes relative to each other.

In accordance with a further aspect of the invention, an example apparatus for steering an electronic beam includes first and second waveguides that enable the propagation of respective first and second waveguide modes, and a controller for steering the beam propagating in free-space by controlling a propagation characteristic of the respective modes relative to each other.

Example methods and corresponding apparatus can further include propagating the multiple modes in a common waveguide so that the mode combining occurs in the common waveguide, as an alternative to spatial mode combining, and the controlling of the relative propagation characteristics of at least one of the modes enables the beam at the open end of the common waveguide to be steered. The common waveguide can further be coupled to the antenna and/or to the first and second waveguides using a splitter/combiner.

Example methods and corresponding apparatus can further include a transmitter for generating the signal, a splitter/combiner for splitting the signal to enable its propagation along two or more paths in respective modes and controlling at least one propagation characteristic in a least one path, and coupling the two or more paths to the waveguide(s).

Example methods and corresponding apparatus can further include first and second paths supporting propagation in respective first and second modes, controlling the propagation characteristic in at least one path, the paths coupled to a common waveguide, a splitter/combiner for combining the paths into a receive signal which is received by a receiver.

The controlled propagation characteristics of the modes can include, for example, the phase, amplitude, polarization, frequency, and/or physical orientation of the waveguide. These controlled propagation characteristics of the modes can be controlled individually or simultaneously. For example, the relative phase and amplitude, or phase, amplitude and polarization, can be simultaneously controlled. The disclosed example method can use any type of waveguide, such as circular, circular corrugated, and/or rectangular waveguide, or any combination of waveguide type. The first mode can be a transverse electric field with a 01-type distribution ($TE_{01}$) mode in circular waveguide and the second mode can be a hybrid electric field with an 11-type distribution ($HE_{11}$) mode in circular corrugated waveguide. The mode combining can be spatial combining, or waveguide combining, or any combination thereof.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

An example embodiment of the present invention relates in general to a method of electronically steering a waveguide beam, and more particularly to steering a beam by mixing propagation modes within a waveguide transmission line feed. An example method involves the mixing of multiple propagating modes in a waveguide, where a waveguide mode refers to a specific energy distribution and electric field orientation supported within a waveguide structure.

Through the use of controlled waveguide mode mixing, the power distribution within a waveguide can be shaped. Controlled waveguide mode mixing can be achieved by controlling the propagation parameters of the multiple propagating modes relative to one another. The propagation parameters can include, for example, the relative phase difference between modes, the relative amplitude of modes, the polarization of the electric field of modes, the physical orientation of the electric fields of modes, as well as the propagation frequency of modes. The RF beam energy resulting from the mixing of modes in waveguide can be directionally steered. In other words, the peak energy distribution of the electric field at the open end of the waveguide can be controlled and steered away from the center of the waveguide. For radar and communications applications, it is possible to use controlled waveguide mode mixing to steer an antenna beam off of the boresight axis of a reflector antenna. The directed beam energy can then be steered electronically without physically moving the antenna. The limited amount of electronic beam steering offers many advantages in a single dish radar system, such as fine-tuned beam pointing and target centering. Those of skill in the art should also recognize that electronic beam steering can also be useful in communications systems in order to receive, or transmit, a stronger signal from an off boresight source.

Figure 1:
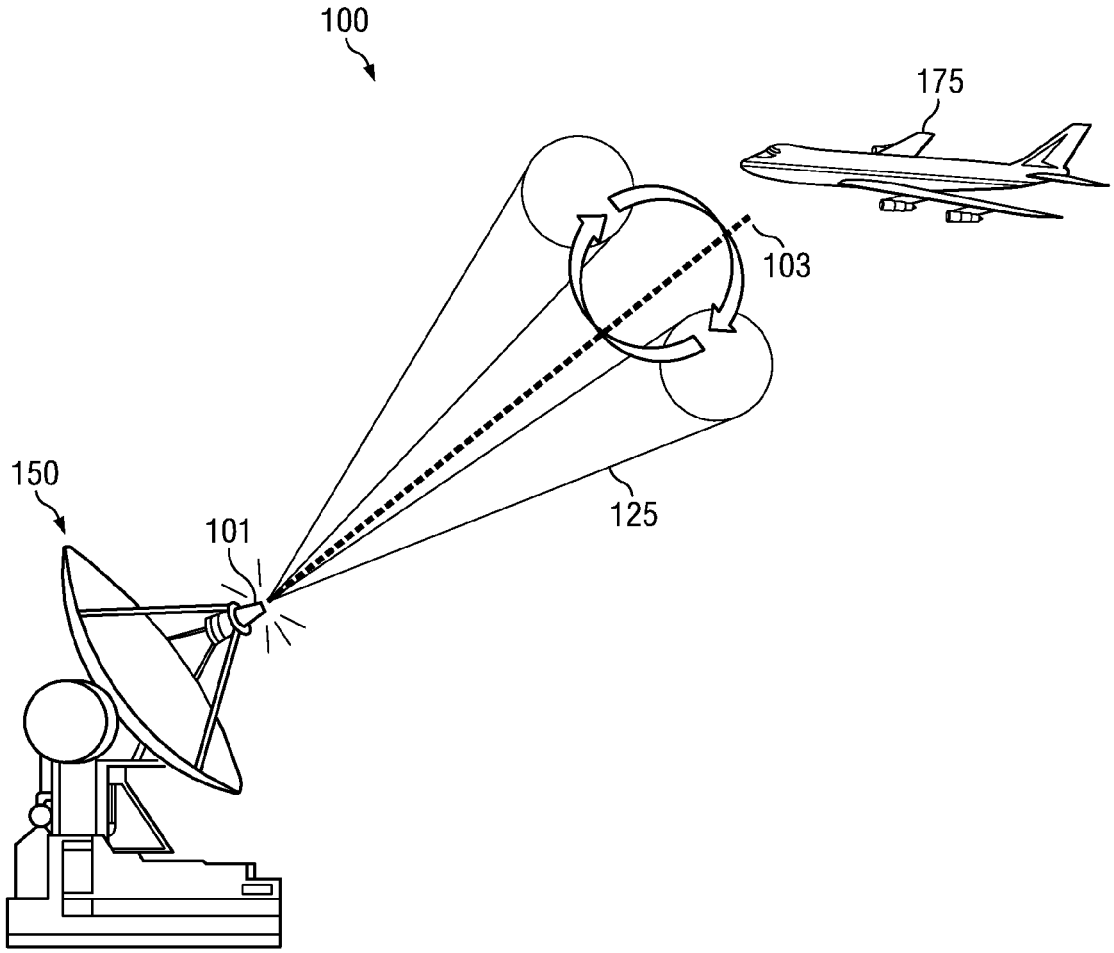
FIG. 1 illustrates an application of an example embodiment of antenna beam steering through the use of waveguide mode mixing in which a radar system uses electronic steering of an antenna beam to provide fine tracking of a target.

FIG. 1 illustrates antenna beam steering through the use of waveguide mode mixing to electronically steer the antenna beam of a radar system 100. The radar antenna 150 is used to track a target 175. An open ended waveguide 100 feeds the radar antenna 150. Through the use of waveguide mode mixing, the antenna beam 125 can be electronically steered off the boresight axis. The electronic steering provides superior beam steering control compared to mechanical beam steering, and therefore enables fine-tuned beam pointing and target centering.

Figure 2:
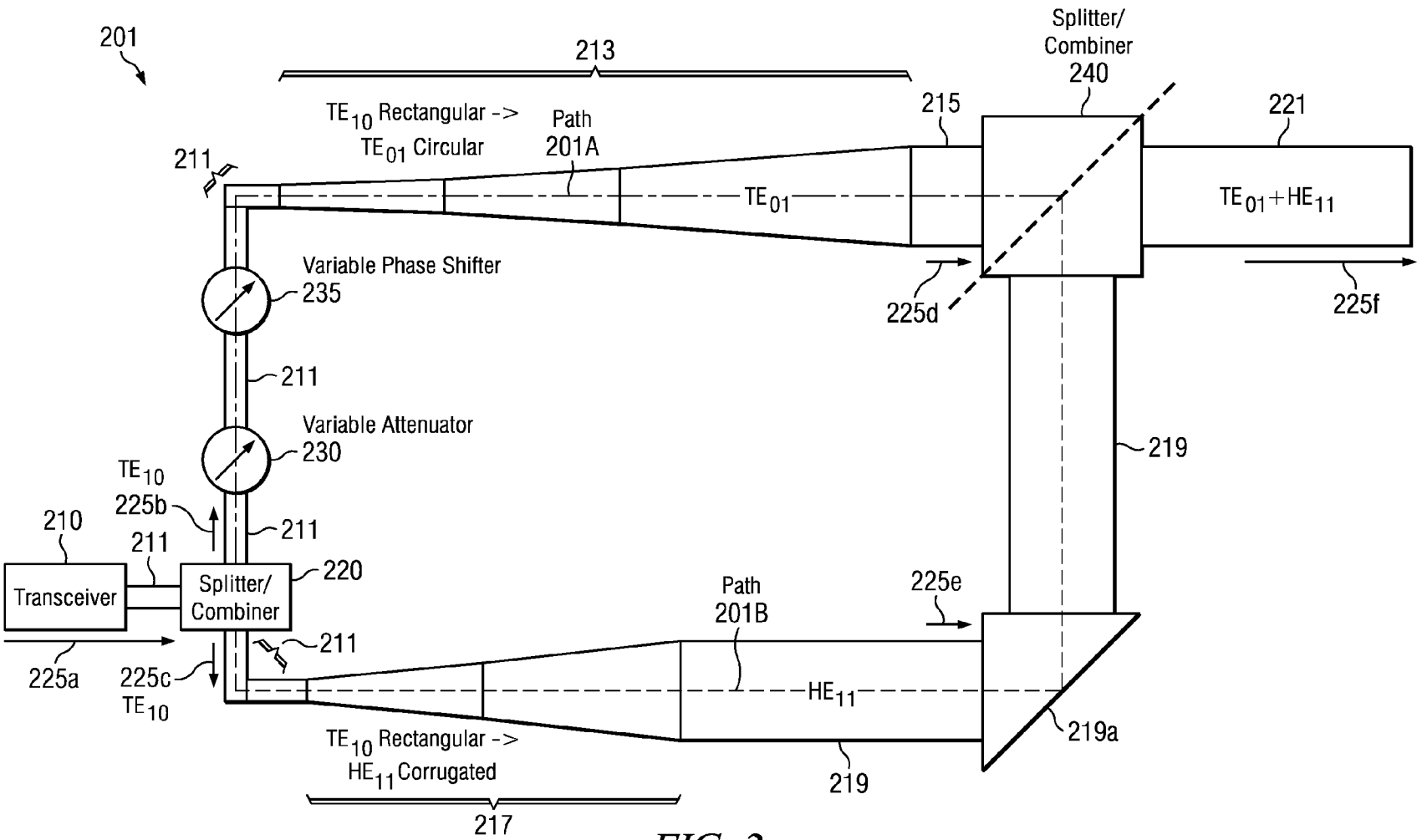
FIG. 2 is a schematic diagram of an example embodiment of beam steering through the use of waveguide mode mixing in which the output of the waveguide is electronically steered by the controlled mixing of multiple waveguide modes.

FIG. 2 is a schematic diagram of an example embodiment of beam steering through the use of waveguide mode mixing in which the output of the waveguide 221 is electronically steered by the controlled mixing of multiple waveguide modes. As one possible configuration for achieving mode mixing in a waveguide transmission line, the RF output of a transceiver can be split into two separate propagation paths. The signal along one path can have its phase adjusted relative to the other path using a commercially available variable phase shifter in a fundamental waveguide. Similarly, the amplitude of the signal propagation along one path can also be controlled using a commercially available variable attenuator.

In FIG. 2, transceiver 210 generates an RF signal 225*a* which travels along standard rectangular waveguide 211 in the fundamental $TE_{10}$ mode. Two separate waveguide modes can be generated from a single rectangular waveguide propagating RF signal 225*a* in the fundamental $TE_{10}$ mode to create conditions for beam steering. (TE refers to transverse electric and the two subscripts ($_{10}$) refer to specific field distributions within waveguide.) RF signal 225*a* can be split into two separate propagation paths, Path 201A and Path 201B, which ultimately rejoin resulting in steered RF signal 225*f*. RF signal 225*a* travels to splitter/combiner 220 which splits RF signal 225*a* into two RF signals 225*b* and 225*c*, which then propagate along separate paths. Power splitters (also called power dividers and, when used in reverse, power combiners) are passive devices commonly used in microwave systems. "Splitter/combiner" is used herein as a term for a device that performs the functions of combing and/or splitting signal power. Whether a splitter/combiner splits or combines signal power depends upon the direction travelled by the signal.

RF Signal 225*b* propagates in the fundamental $TE_{10}$ mode along a path that contains attenuator 230 and phase shifter 235 in standard rectangular waveguide transition section 211. At waveguide transition 213, which can be, for example, a commercially available mode converter, RF signal 225*b* is converted from fundamental $TE_{10}$ mode into RF signal 225*d* propagating in the $TE_{01}$ mode. RF signal 225*d* then travels through circular waveguide 215 to splitter/combiner 240.

RF signal 225*c* travels along standard rectangular waveguide in the $TE_{10}$ fundamental mode until it reaches waveguide transition 217, which can be, for example, another kind of commercially available mode converter, which transitions to circular corrugated waveguide 219. RF signal 225*b* is converted from the fundamental $TE_{10}$ mode to RF signal 225*e* in the $HE_{11}$ mode. RF signal 225*f* $HE_{11}$ mode continues to travel through circular corrugated waveguide 219, through a 90° bend 219*a*, through additional waveguide 219, to splitter/combiner 240. Hybrid combiner 240, which can be, for example, an overmoded hybrid combiner, combines RF signal 225*d* and RF signal 225*e* resulting in RF signal 225*f*. RF signal 225*f* propagates from the open end of waveguide 221, which can be, for example, a common waveguide having a large diameter, such that it can supports many propagating modes. The closed end of waveguide 221 is tapered to both the circular waveguide 215 and the corrugated guide 219.

The resulting output RF signal 225*f* of combiner 240 is a mixture of RF signal 225*d* $TE_{01}$ mode and RF signal 225*e* $HE_{11}$ mode. The electric fields of these two modes can be individually computed and summed together to determine the resulting mixed mode field pattern. The beam energy, i.e., RF signal 225*f*, shifts within the guide, depending on the phase and amplitude of one mode relative to the other mode. The combination of these two propagation paths, Paths 201A and 201B, can control the beam motion in the horizontal direction.

Although FIG. 2 has been generally described from a transmission, or a transmitter, point of view, those of skill in the art should recognize that the method is equally applicable to reception, or a receiver. For example, transceiver 210, which is a device comprised of both a transmitter and a receiver sharing common circuitry in a single housing, can also function as an RF receiver rather than an RF transmitter. Furthermore, because the method is equally applicable to both transmission and reception, those of skill in the art should recognized that the transceiver can be replaced by a transmitter, capable of only transmission, or a receiver, capable of only reception.

Those of skill in the art should also recognize that the control of the propagation characteristics, such as those controlled by attenuator and phase shifters, can occur in other path legs, or can occur in separate path legs, for example, attenuation can occur in Path 201A and phase shifting can occur in Path 201B.

Figure 3A:
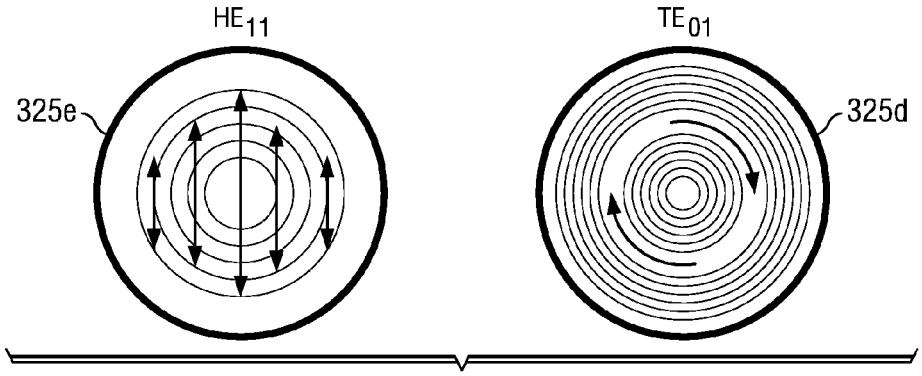
FIGS. 3A and 3B illustrate a cross-sectional view of electric fields of two un-mixed modes, with various relative phase differences, propagating in circular and circular corrugated waveguide and the resultant electric fields produced by the mixing of the two modes in waveguide.

FIG. 3A is a cross-sectional illustration of the electric fields of two propagating modes in circular corrugated waveguide. The electric field of a $HE_{11}$ mode 325*e* is shown for a cross section of circular corrugated waveguide on the left side of FIG. 3A. The direction of the electric field lines are illustrated by the lines with arrows. For the $HE_{11}$ mode the electric field intensity is at a peak at the center of the waveguide. For the $TE_{01}$ mode the electric field intensity is at a peak near the radius midpoint, with a purely azimuthal component, forming a ring-shaped intensity pattern.

Figure 3B:
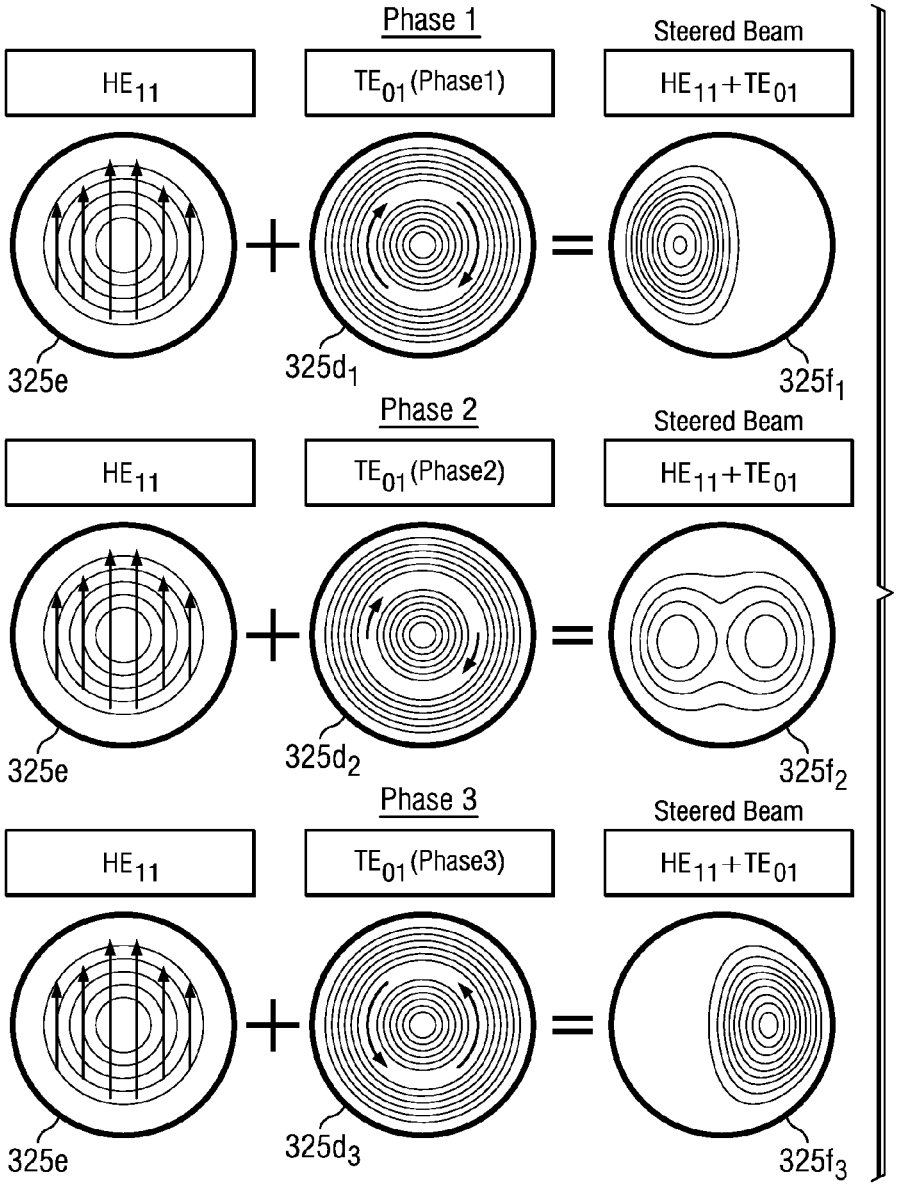

FIG. 3B is an illustration of analytically derived steered output beams for three examples having three different relative phase differences between the $HE_{11}$ and $TE_{01}$ modes. The beam energy shifts within the guide depending on the phase and amplitude of one mode relative to the other. It should be noted that $TE_{01}$ mode has a cross polarization component that does not contribute to the resulting beam shift. These analytical results are valid for a waveguide system which filters out the cross polarization component, which can be done using a wire grid polarizer or other similar component.

The precise motion of the beam center along the x-axis, in terms of phase and amplitude attenuation control parameters, and the waveguide radius r is expressed as sinusoidally as:

$$x(\alpha,\theta_o)=-0.658r\sqrt{\alpha}\sqrt{1-\alpha}\cos\theta_o$$

where $\alpha$ is the attenuation of the $TE_{01}$ mode, or ratio of the $TE_{01}$ power to the total power, and $\theta_0$ is the phase difference between the two modes. In this instance, the $TE_{01}$ circular mode in one signal path is simply the sum of an $LP_{11}$ mode (linear polarization) with the fields aligned with the $HE_{11}$ mode in the other signal path. In other words, the beam steering is the result of the vector addition of the $TE_{01}$ and $HE_{11}$ electric fields. The cross-polarized $LP_{11}$ mode portion of the $TE_{01}$ mode can be filtered out using a wire grid polarizer.

The beam center shift is not the only phenomenon resulting from the mixture of the two modes. The phase front of the beam radiated at the end of the guide has a tilt, which is also a function of phase and amplitude attenuation:

$$\varphi(\alpha,\theta_o)=0.466\frac{\lambda}{r}\sqrt{\alpha}\sqrt{1-\alpha}\sin\theta_o$$

where $\lambda$ is the free space wavelength of the signal. Note that the phase tilt, as controlled by the signal phase shift $\theta_0$ is 90° out-of-phase with the beam center change. Therefore, the phase tilt is at a maximum when the beam is centered ($\theta_o$=90°) and the phase font is flat at the maximum excursion of the beam ($\theta_o$=0°).

Figure 4A:
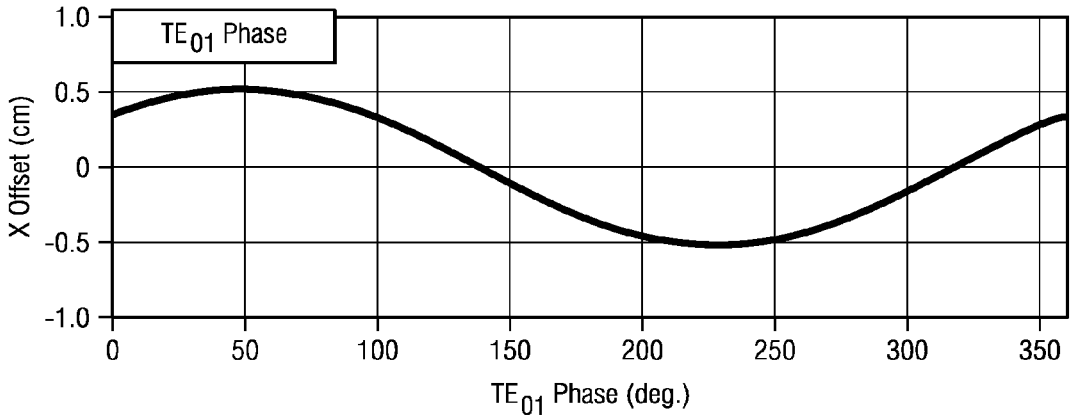
FIG. 4A illustrates the theoretical waveguide beam offset obtained by controlling the relative phase difference between the mixed waveguide modes.

FIG. 4A illustrates the theoretical waveguide beam offset obtainable as a function of the phase of the $TE_{01}$ mode relative to the $HE_{11}$ mode for a specific example. For a waveguide mode mixing embodiment as shown in FIG. 2, the beam offset from center can be controlled along one axis, such as the x-axis in FIG. 4A. The maximum and minimum offsets, which are in this example approximately +0.5 cm and −0.5 cm, respectively, occur around 50° and 230°, respectively, while no offset occurs, i.e., the beam is centered, at roughly 140° and 320° of phase difference.

Figure 4B:
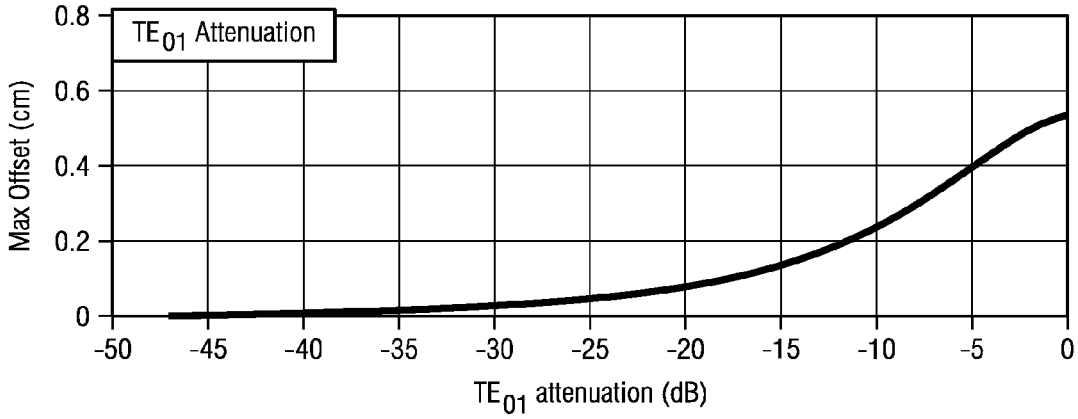
FIG. 4B illustrates the theoretical waveguide beam offset achieved by controlling the relative amplitude of one of the mixed waveguide modes with respect to a second mixed waveguide mode.

FIG. 4B illustrates the theoretical waveguide beam offset obtainable as a function of the attenuation of the amplitude of the $TE_{01}$ mode for a specific example. The maximum offset occurs at the minimum attenuation, which means that the full amplitude of the $TE_{01}$ mode is being constructively added to the $HE_{11}$ mode, resulting in a shift of the beam at the open-ended waveguide.

The beam offset as a function of both attenuation and phase difference can be described by the following equation:

$$\delta(z)=-\delta_{max}\cos[(\Delta k)z+\theta_0]$$

where $\delta_{max}=2b_{12}|(C_1C_2^*)|$, $(\Delta k)z$ is the phase difference between the two modes, $\theta_0$ is the phase difference at z=0, coefficient $b_{12}$=0.329a for $HE_{11}$ and $TE_{01}$ modes, a is the waveguide radius, $C_1$ is the amplitude and phase percentage of $TE_{01}$. The expression is shown as a function of propagation distance, z, but in this case z may be considered fixed, and the expression is therefore a function solely of relative amplitude ($C_1$ and $C_2$) and relative phase (θo).

To demonstrate beam steering by way of waveguide mode mixing, a series of W-band components were assembled and tested in the configuration depicted in FIG. 2. A solid state amplifier was used as a common source producing a signal at 96 GHz. A mode converter was used to transform the signal propagating in the fundamental $TE_{10}$ mode in rectangular waveguide (WR-10) to $TE_{01}$ mode propagating in circular waveguide, which was then tapered up to a 1.25 inch diameter waveguide. A different mode converter was used to transition the signal propagating in the fundamental $TE_{10}$ mode in WR-10 mode to the $HE_{11}$ mode propagating in corrugated waveguide. A four-port quartz plate hybrid was used to combine the $HE_{11}$ and $TE_{01}$ modes. Mismatched energy was dissipated in one of the output ports of the hybrid, while the summed energy of the two modes was directed to the 1.25 inch diameter corrugated waveguide section. The beam was radiated into free space, where a 2-D scanner measured the power content of the beam.

Figure 5A:
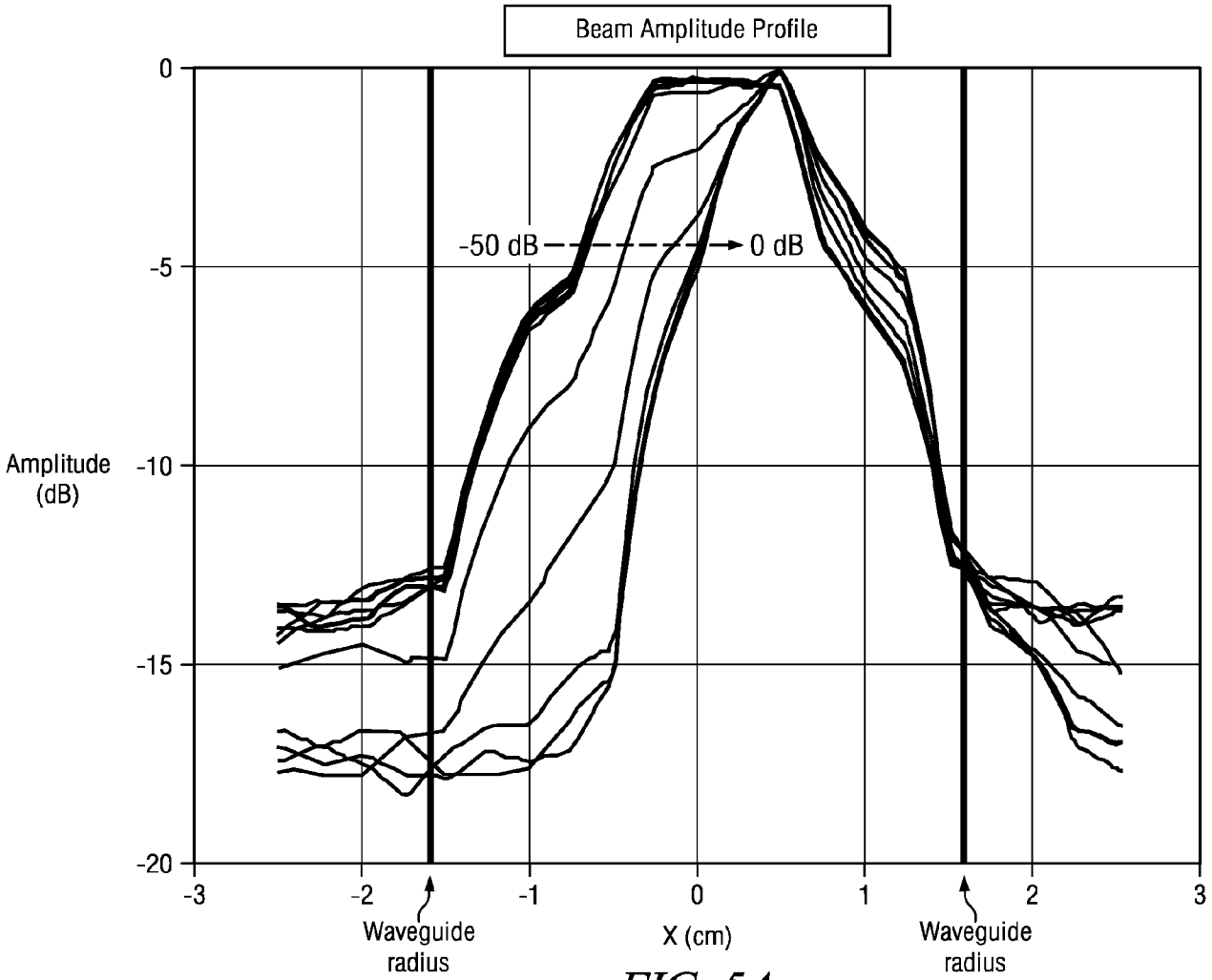
FIG. 5A is a plot of the measured amplitude profiled of the output waveguide beam along the horizontal axis resulting from controlled mixing of two waveguide modes, where the relative amplitude of one of the mixed modes is controlled by a variable attenuator, at various attenuator settings.

FIG. 5A is a plot of the measured amplitude profile of the waveguide beam along the horizontal axis (x-axis) resulting from the controlled mixing of $HE_{11}$ and $TE_{01}$ modes, where the relative amplitude of the $TE_{01}$ mode is controlled by a variable attenuator, at multiple attenuator settings. As the amount of attenuation to the $TE_{01}$ mode decreases, the beam shifts from the center of the waveguide along the x-axis.

Figure 5B:
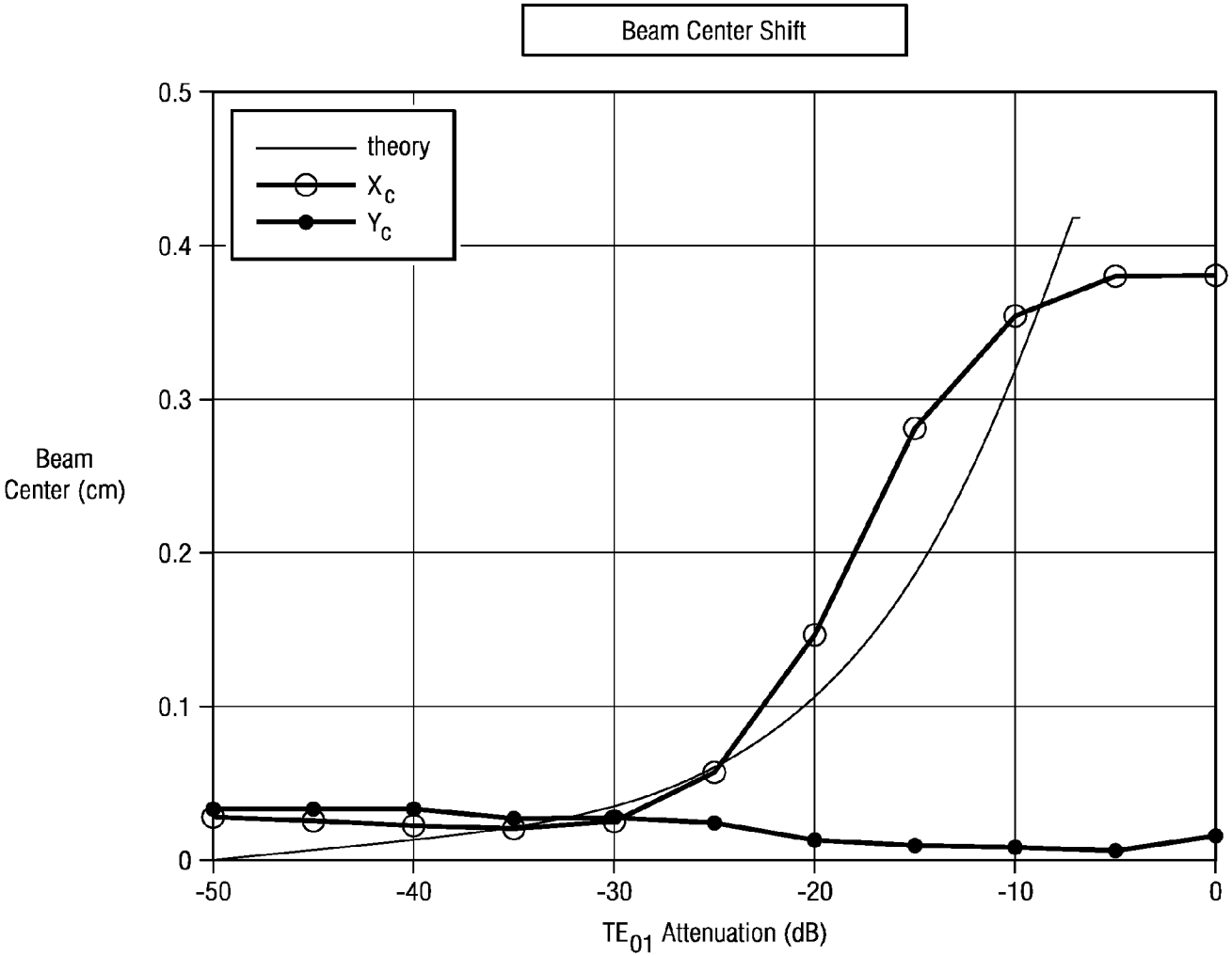
FIG. 5B is a plot illustrating the measured shift of the peak of the beam output of the waveguide along the horizontal axis as a function of various attenuator settings applied to one waveguide mode, where the relative amplitude of one of the mixed modes is controlled by a variable attenuator.

FIG. 5B is a plot illustrating the measured shift of the beam peak along the horizontal axis as a function of applied attenuation. The plot shows theoretical value in addition to the measured values for the x-axis and y-axis. As the attenuation of the $TE_{01}$ mode is decreased and more $TE_{01}$ content is included, the beam peak shifts away from the center of the waveguide along the x-axis. FIG. 5B also shows the relative independence along the y-axis as the beam peak remains stable in that direction.

Figure 6:
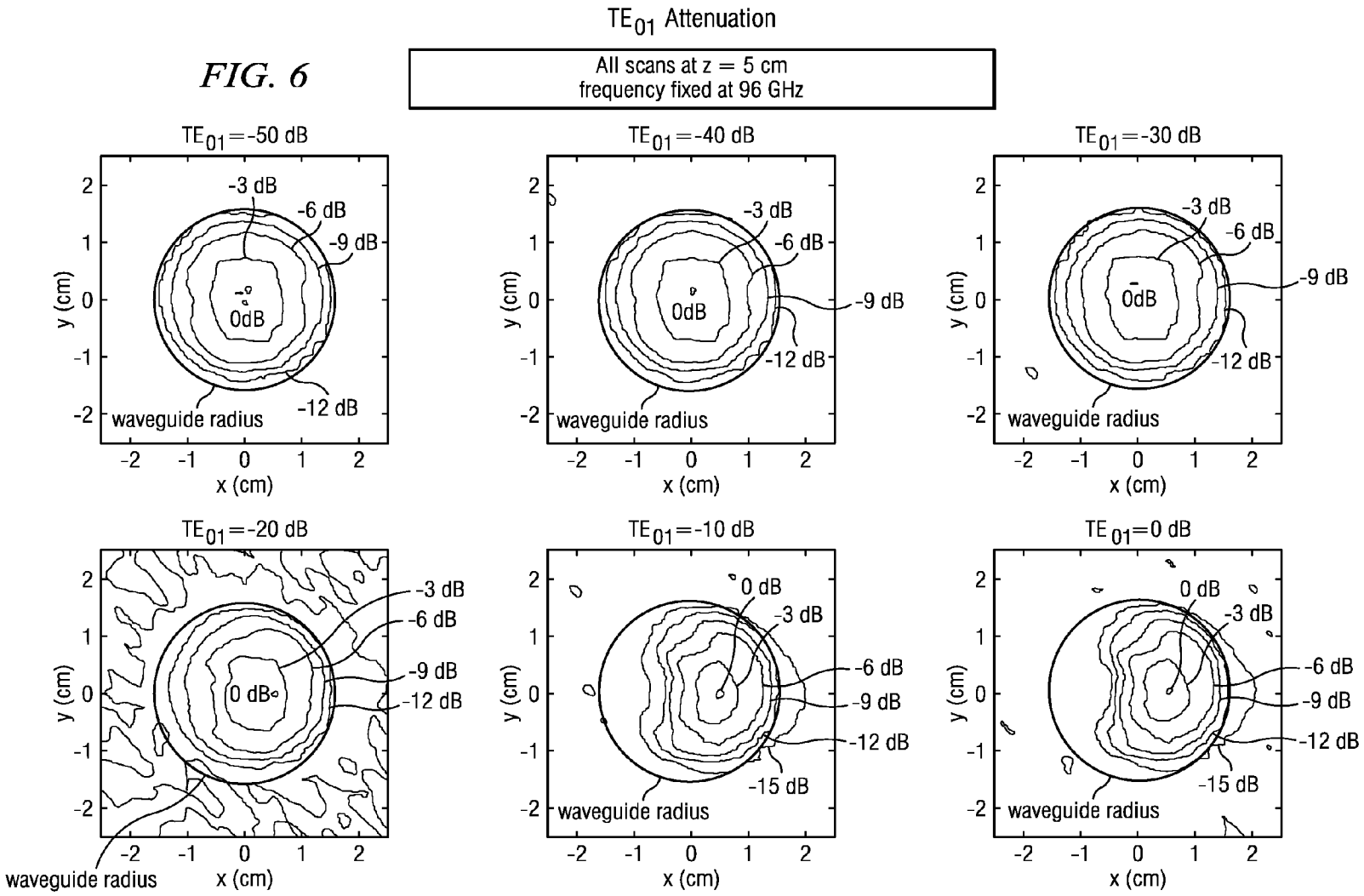
FIG. 6 illustrates a cross-sectional view of the measured output power of the waveguide resulting from controlled mixing of two waveguide modes, where the relative amplitude of the $TE_{01}$ mode is controlled by a variable attenuator, for various attenuator settings.

FIG. 6 illustrates a cross-sectional view of the measured waveguide beam patterns resulting from controlled mode mixing for a number of attenuation settings applied to the $TE_{01}$ mode. All 2-D scan measurements were taken 5 cm away in the z-axis at a fixed frequency of 96 GHz. FIG. 6 shows that when the $TE_{01}$ mode is attenuated by 50 dB, the peak of the beam is at the center of the waveguide. The peak of the beam incrementally shifts towards the positive x-axis side of the waveguide, in right-hand coordinating system where +z is directed out of the page, as the attenuation applied to the $TE_{01}$ mode is decreased until the limit is reached. FIG. 6 shows that when $TE_{01}$ is not attenuated at all, the peak of the beam signal is located about +0.5 cm along the x-axis of the waveguide.

Figure 7A:
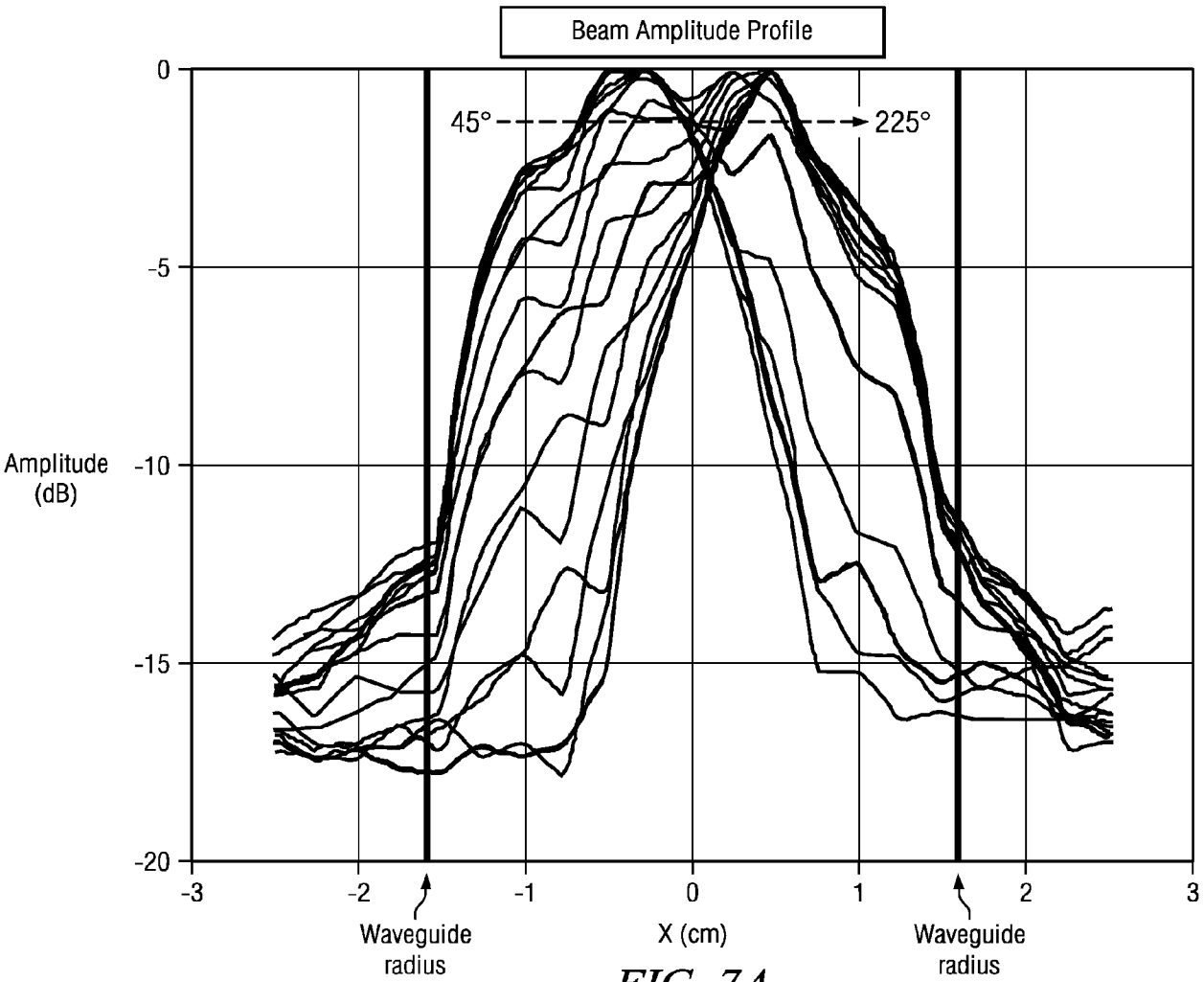
FIG. 7A is a plot of the measured amplitude profile of the output waveguide beam along the horizontal axis resulting from controlled mixing of two waveguide modes, where the relative phase of one of the mixed modes is controlled by a variable phase shifter, at various phase shifter settings.

FIG. 7A is a plot of the measured amplitude profile of the waveguide beam along the horizontal axis (x-axis) resulting from the controlled mixing of $HE_{11}$ and $TE_{01}$ modes, where the relative phase of the $TE_{01}$ mode is controlled by a variable phase shifter, at multiple phase shifter settings. As the relative phase difference between the $TE_{01}$ mode and $HE_{11}$ mode changes, the beam shifts from one side of the waveguide (−x-axis) to the other side of the waveguide (+x-axis). From the equation above, the maximum distance that can be travelled along the x-axis is about 1.0446 cm, from about −0.5223 cm from center to about +0.5223 cm from center. The radius of the waveguide is around 1.6 cm.

Figure 7B:
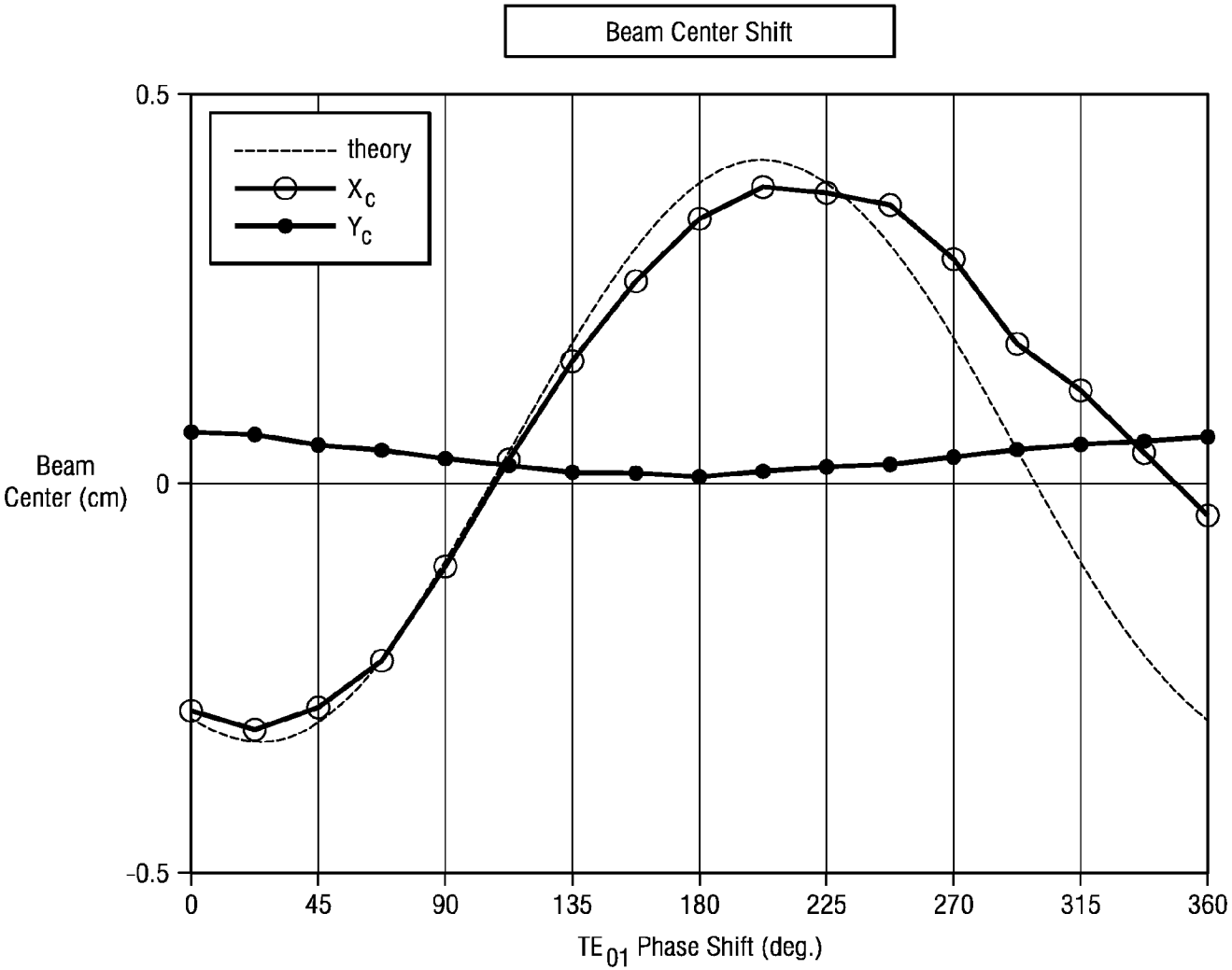
FIG. 7B is a plot illustrating shift of the measured center of the beam output of the waveguide along the horizontal axis as a function of various phased shifter settings applied to one waveguide mode, where the relative phase difference between the mixed modes is controlled by a variable phase shifter.

FIG. 7B is a plot illustrating the measured shift of the beam peak along the horizontal axis as a function of phase shift. The plot shows theoretical value in addition to the measured values for the x-axis and y-axis. As the phase shift of the $TE_{01}$ mode is changed relative to the $HE_{11}$ mode, the beam peak cycles along the x-axis from about −0.3 cm to about +0.3 cm. FIG. 7B also shows illustrates the relative independence along the y-axis as the beam peak remains stable in that direction.

Figures 8, 8A:
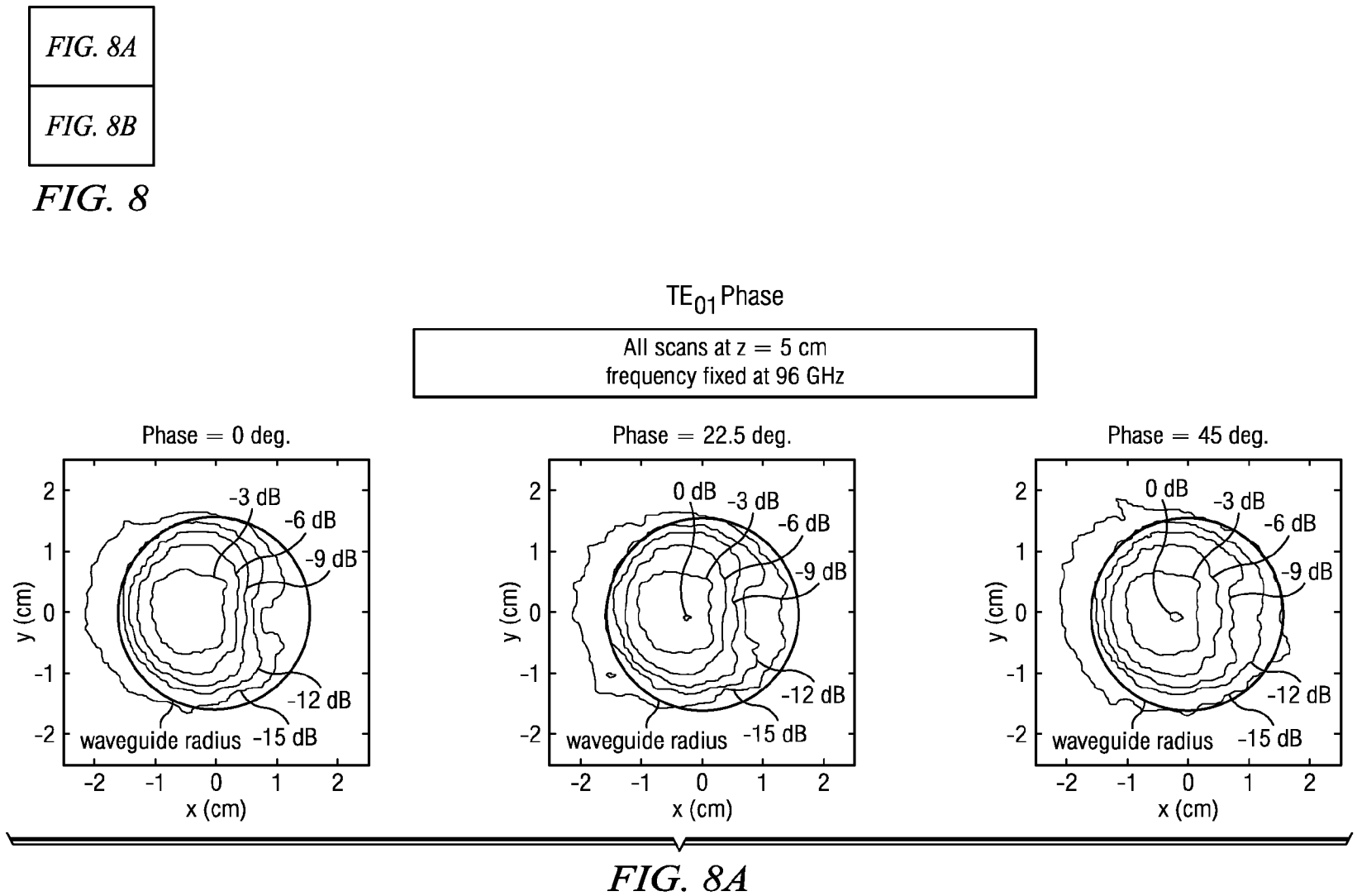
FIG. 8 illustrates a cross-sectional view of the measured output power of the waveguide resulting from controlled mixing of two waveguide modes, where the relative phase of the $TE_{01}$ mode is controlled by a variable phase shifter, for various phase shifter settings.
Figure 8B:
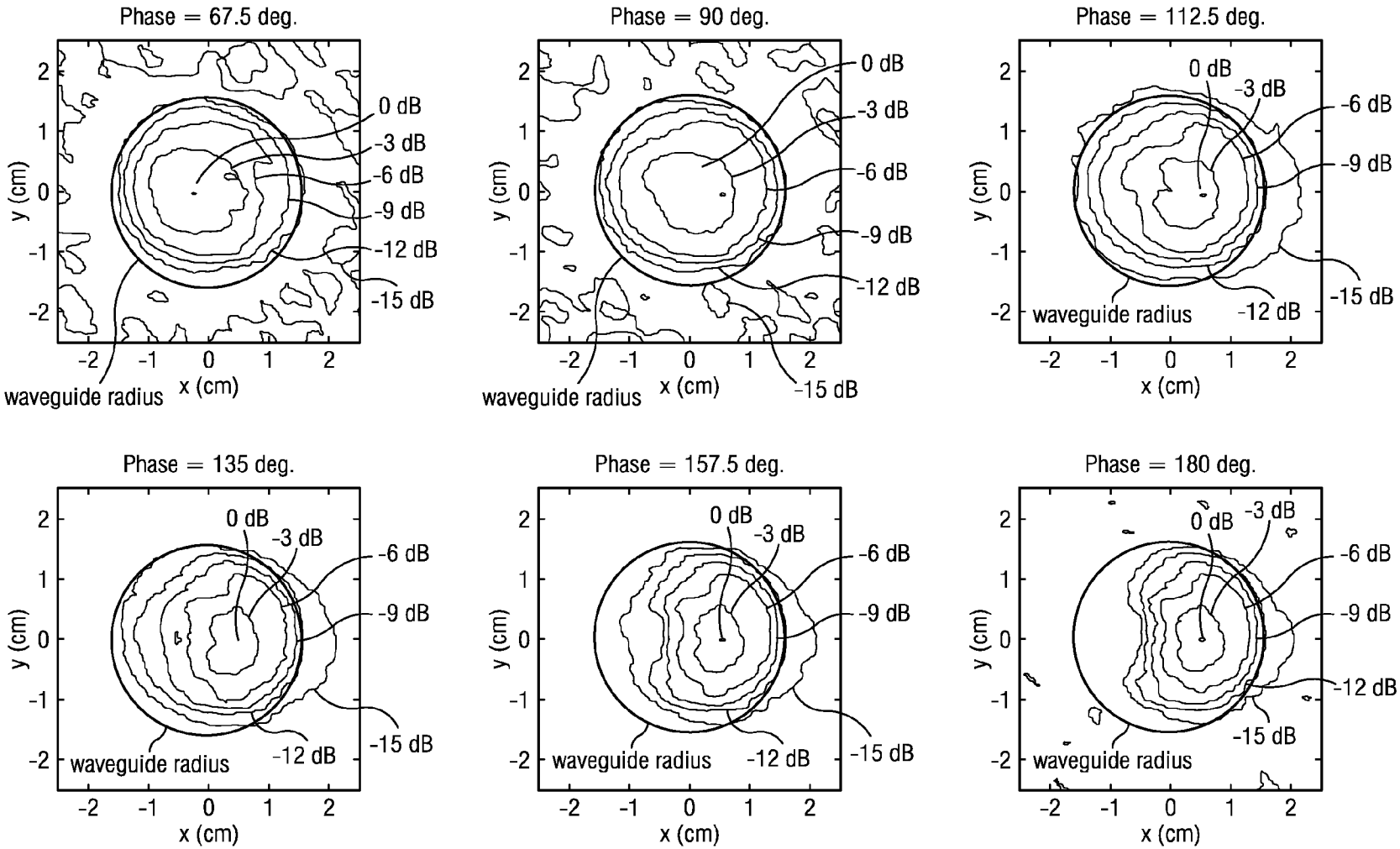

FIG. 8 illustrates a cross-sectional view of the measured waveguide beam patterns resulting from controlled mode mixing for a number of phase shifter settings applied to the $TE_{01}$ mode. All 2-D scan measurements were taken 5 cm away in the z-axis at a fixed frequency of 96 GHz. FIG. 8 shows that when the $TE_{01}$ mode has a phase shift of 45°, the peak of the beam is steered toward the −x-axis of the waveguide, assuming a right-hand coordinate system with +z coming out of the page toward the reader. The peak of the beam incrementally shifts towards the positive x-axis side of the waveguide as the phase shift applied to the $TE_{01}$ mode is increased until the limit is reached.

Figure 9:
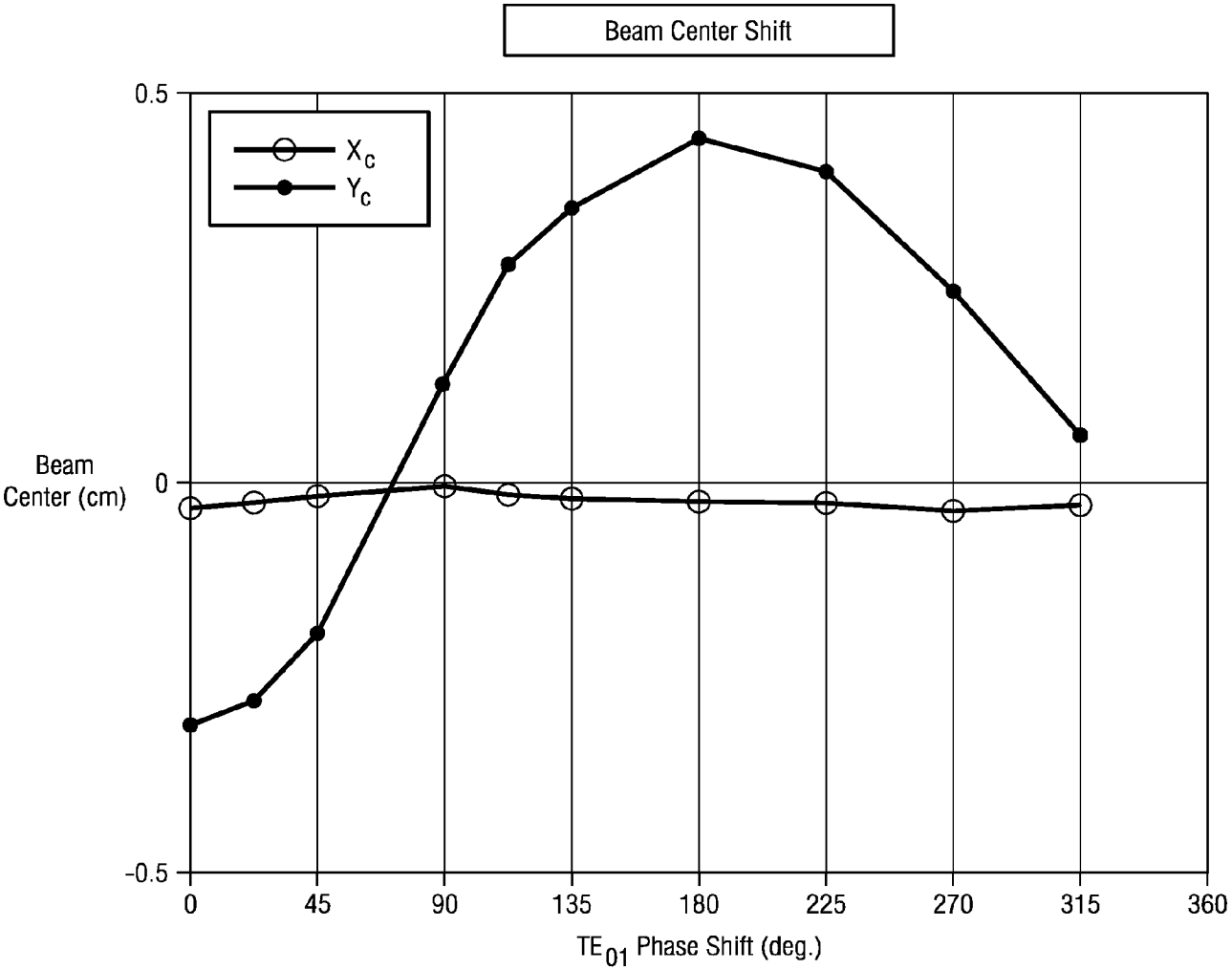
FIG. 9 is a plot illustrating shift of the measured center of the beam output of the waveguide along the vertical axis as a function of various phased shifter settings applied to one waveguide mode, where the relative phase difference between the mixed modes is controlled by a variable phase shifter.

FIG. 9 shows the beam center shift for a configuration in which the spatial direction of the $HE_{11}$ mode has been orthogonally rotated 90°. Here, the beam is being shifted in the y-direction, the phase of the $TE_{01}$ mode is being shifted relative to that of the $HE_{11}$ mode. In FIG. 9A the shift of peak of the beam along the y-axis occurs at 0° and 360° of phase shift for the $TE_{01}$ mode. The plot also shows that the beam center is relatively stable along the x-axis, as there is very little movement of the beam in that direction.

Figure 10:
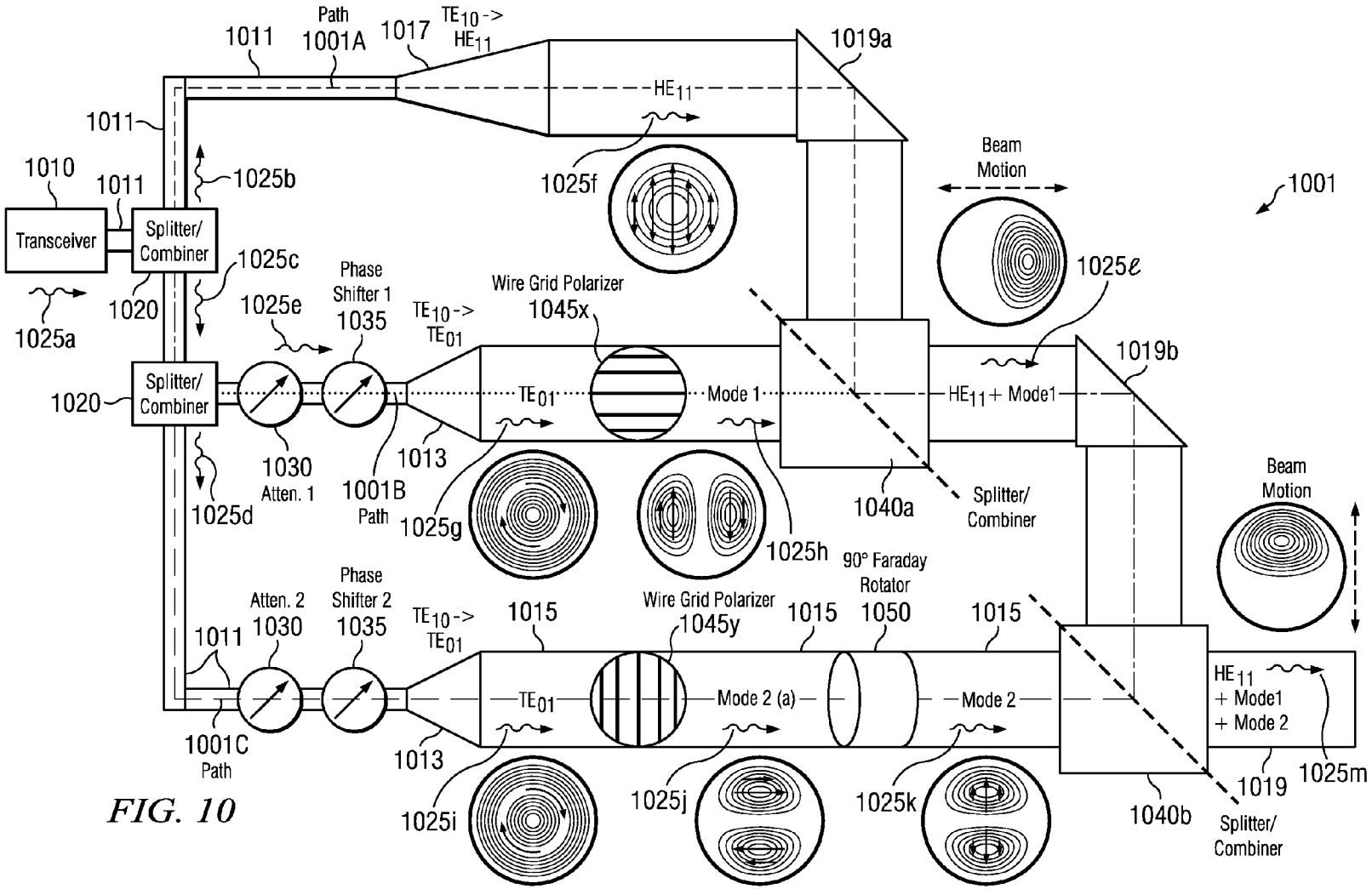
FIG. 10 is a schematic diagram of an example multiple waveguide mode mixer enabling steered beam control in both horizontal and vertical directions.

FIG. 10 is a schematic diagram of an example multiple mode mixer. The beam motion resulting from the schematic diagram of FIG. 10 can be controlled in both the vertical and horizontal directions. Transceiver 1010 which generates an RF signal 1025*a* which travels along standard rectangular waveguide 1011 in the fundamental $TE_{10}$ mode. RF signal 1025*a* can be divided among three separate propagation paths, Path 1001A, Path 1001B and Path 1001B, which ultimately rejoin resulting in steered RF signal 1025*m*. RF signal 1025*a* travels to splitter/combiner 1020 which splits RF signal 1025*a* into two signals 1025*b* and 1025*c*, which then propagate along separate paths.

RF signal 1025*b* travels along standard waveguide in the $TE_{01}$ fundamental mode until it reaches waveguide transition 1017 which transitions to circular corrugated waveguide 1019. RF signal 1025*b* is converted from the fundamental $TE_{10}$ mode to RF signal 1025*f* in the $HE_{11}$ mode. RF signal 1025*f* in the $HE_{11}$ mode continues to travel through circular corrugated waveguide 1019, through a 90° bend 1019*a*, through additional waveguide 1019, to splitter/combiner 1040*a*.

RF signal 1025*c* propagating in the fundamental $TE_{10}$ mode travels to second splitter/combiner 1021 and is split again into two RF signals 1025*d* and 1025*e*. RF Signal 1025*e* propagates in the fundamental $TE_{10}$ mode along a path that contains attenuator 1030 and phase shifter 1035 in standard rectangular waveguide transition section 1013. At waveguide transition 1013, RF signal 1025*e* is converted from fundamental $TE_{10}$ mode into RF signal 1025*g* propagating in the $TE_{01}$ mode. Signal 1025*g* then travels through waveguide 1015 to wire grid polarizer 1040*x* which creates polarized RF signal 1025*h*. Polarized RF signal 1025*h* travels to splitter/combiner 1040*a*.

Splitter/combiner 1040*a* combines RF signal 1025*h* and RF signal 1025*f* resulting in RF signal 1025*l*. The combination of these two propagation paths, Paths 1001A and 1001B, control the beam motion in the horizontal direction.

RF signal 1025*d* propagates in the fundamental $TE_{10}$ mode along another Path 1001C. Attenuator 2 1030*b* and phase shifter 2 1035*b* are used to control the relative phase and amplitude of RF signal 1025*d*. RF signal 1025*d* propagating in the fundamental $TE_{10}$ WR-10 mode transitions to the RF signal 1025*i* in the $TE_{01}$ circular waveguide mode in transition waveguide 1013. Wire grid polarizer 1045Y filters RF signal 1025*i* resulting in RF signal 1025*j* (mode 2). 90° Faraday rotator 1050 rotates the physical orientation of the electrical fields of RF signal 1025*j* 90°, creating RF signal 1025*k*, which propagates (mode 2) along waveguide path 1015. RF signal 1025*k* enters a second splitter/combiner 1040*b* and combines with signal 1025*l* to form the resultant steered waveguide beam, RF signal 225*m*. The schematic diagram of FIG. 10 shows an example of controlling the waveguide beam in both the vertical and horizontal directions. These controls are independent and thus enable the waveguide beam to be directionally steered in any horizontal and vertical combination.

Although FIG. 10 has been generally described from a transmission, or a transmitter, point of view, those of skill in the art should recognize that the method is equally applicable to reception, or a receiver. For example, transceiver 1010, which is a device comprised of both a transmitter and a receiver sharing common circuitry in a single housing, can also function as an RF receiver rather than an RF transmitter. Furthermore, because the method is equally applicable to both transmission and reception, those of skill in the art should recognized that the transceiver can be replaced by a transmitter, capable of only transmission, or a receiver, capable of only reception.

Those of skill in the art should also recognize that the control of the propagation characteristics, such as those controlled by attenuator and phase shifters, can occur in other path legs, in separate path legs, or in any combination thereof A mathematical description of an example of using waveguide mode mixing to create a beam offset follows. The example describes the mixing of a $HE_{11}$ mode signal (designated as Mode 1) with a $TE_{01}$ mode signal (designated as Mode 2).

Mode 1

Figure 11A:
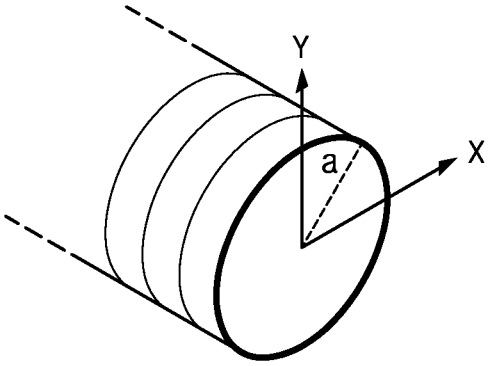
FIGS. 11A and 11B illustrate the coordinate system and geometry, and an example of electrical fields situated within the geometry, used in mathematical description of an $HE_{11}$ waveguide mode in circular corrugated waveguide.

A mathematical description of $HE_{11}$-Mode 1 follows. FIG. 11A illustrates the coordinate system and geometry used in the following description. $HE_{11}$ mode is also known as the $LP_{01}$ mode, where LP means linear polarized. Electric field components for $LP_{mn}$ modes in circular corrugated waveguide can be given as:

$$E_{y_{mn}}(r, \varphi, z, t) = AJ_m\left(\frac{P_{mn}r}{a}\right)e^{j(\omega t - k_{z_{mn}}z)}$$

where: A is amplitude; $J_m$ is bessel function of order m; $P_{mn}$ is $n^{th}$ zero of $m^{th}$ Bessel function; a is waveguide radius; ω is frequency; $k_{z_{mn}}$ is axial wavenumber of LP mode m, n; $k^2=k_\perp^2+k_z^2$; k is wavenumber; $k=\omega/c$; c is speed of light; $k_\perp$ is perpendicular wavenumber; and $k_\perp=p_{mn}/a$.

Figure 11B:
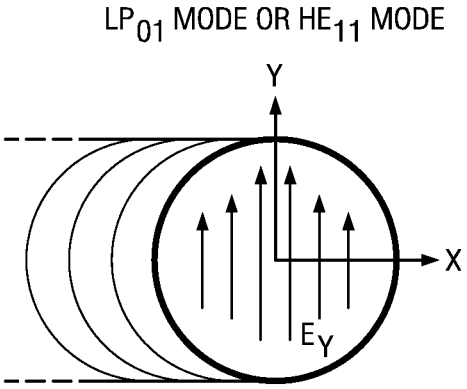

FIG. 11B illustrates an example of $HE_{11}$ (or $LP_{01}$) electrical fields situated within circular corrugated waveguide geometry. For $LP_{01}$ mode (m=0, n=1), this can be described mathematically as:

$$E_{y_{01}}(r, \varphi, z, t) = AJ_0\left(\frac{P_{01}r}{a}\right)e^{j(\omega t - k_{z_{01}}z)}$$

where:

$$P_{01} = 2.405;\ \text{and},\ k_{z_{01}}^2 = k^2 - k_\perp^2 = \left(\frac{\omega}{c}\right)^2 - \left(\frac{P_{01}}{ac}\right)^2$$

$$E_{y_{01}}(r, \varphi, z, t) = E_{01}^\perp(r, \varphi)e^{j(\omega t - k_{z_{01}}Z)}.$$

where:

$$E_a^\perp(r, \varphi) = AJ_0\left(\frac{P_{01}r}{a}\right).$$

Determining a normalization factor for Mode 1 yields:

$$N_{mn}=\int_0^a\int_0^{2\pi}[E^\perp_{mn}(r,\phi)]^2 r dr d\phi$$

$$N_{01}=A^2\pi a^2 J^2(P_{01})$$

Therefore, the normalized linear electric field is:

$$U_{mn} = \frac{Ey_{mn}^\perp}{\sqrt{N_{mn}}}$$

$$U_{01}(r, \varphi) = \frac{Ey_{01}^\perp}{\sqrt{N_{01}}} = \frac{AJ_0\left(\frac{P_{01}r}{a}\right)}{A\sqrt{\pi}\, aJ_1(P_{01})}$$

For a normalized linear field of $LP_{01}$ mode ($HE_{11}$ mode) in corrugated waveguide, this can be simplified as:

$$U_{mode1}(r, \varphi) = \frac{1}{a\sqrt{\pi}\, J_1(P_{01})}J_0\left(\frac{P_{01}r}{a}\right).$$

Mode 2

Figure 12A:
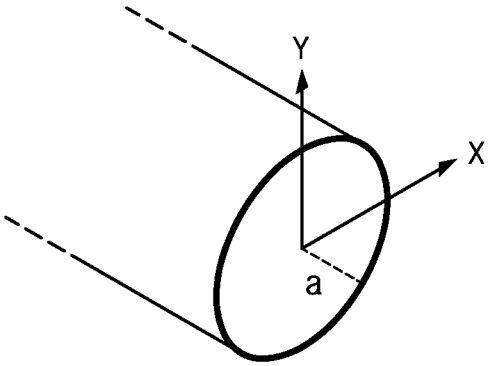
FIGS. 12A and 12B illustrate the coordinate system and geometry, and an example of electrical fields situated within the geometry, used in mathematical description of a $TE_{01}$ waveguide mode in circular waveguide.
Figure 12B:
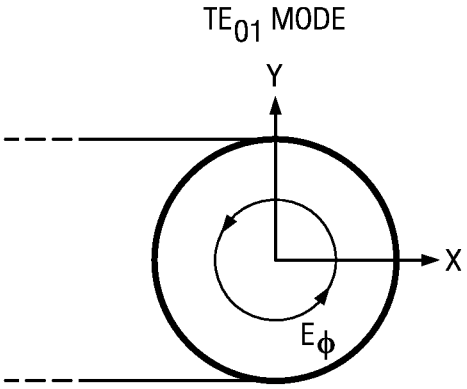

A mathematical description of $TE_{01}$-Mode 2 follows. FIG. 12A illustrates the coordinate system and geometry used in the following description. Electric field components for $TE_{mn}$ modes in circular waveguide can be described as:

$$Er_{mn}(r, \varphi, z, t) = -kB\frac{1}{2}\left[J_{m-1}\left(\frac{q_{mn}r}{a}\right)\right]\sin(m\varphi)e^{j(\omega t - k_{z_{mn}}z)}$$

$$E\varphi_{mn}(r, \varphi, z, t) = B\frac{1}{2}\left[J_{m-1}\left(\frac{q_{mn}r}{a}\right) - J_{m+1}\left(\frac{q_{mn}r}{a}\right)\right]\cos(m\varphi)e^{j(\omega t - k_{z_{mn}}z)}$$

where: $J_m$ is Bessel function of order m; B is amplitude; $q_{mn}$ is $n^{th}$ zero of derivative of $m^{th}$ Bessel function; a is waveguide radius; ω is frequency; $k_{z_{mn}}$ is axial wavenumber of mode $TE_{mn}$ such that $k^2=k_\perp^2+k_z^2$; and $k_\perp=q_{mn}/a$.

For $TE_{01}$ mode (m=0, n=1):

$$E_r(r,\varphi,z,t) = -kB\frac{1}{2}\left[J_{-1}\left(\frac{q_{01}r}{a}\right)+J_1\left(\frac{q_{01}r}{a}\right)\right]\sin(0)e^{j(\omega t-k_{z01}z)}$$
$$= 0, \text{ since } \sin(0)=0;$$

$$E_\varphi(r,\varphi,z,t) = B\frac{1}{2}\left[J_{-1}\left(\frac{q_{01}r}{a}\right)+J_1\left(\frac{q_{01}r}{a}\right)\right]\cos(0)e^{j(\omega t-k_{z01}z)}$$
$$= BJ_1\left(\frac{q_{01}r}{a}\right)e^{j(\omega t-k_{z01}z)}$$

Converting from polar to Cartesian coordinates (using $E_x=E_r\cos\phi-E_\phi\sin\phi$, and $E_y=E_r\sin\phi+E_\phi\cos\phi$) yields:

$$E_x(r,\varphi,z,t) = -BJ_1\left(\frac{q_{01}r}{a}\right)\sin\varphi e^{j(\omega t-k_{z01}z)}$$

$$E_y(r,\varphi,z,t) = BJ_1\left(\frac{q_{01}r}{a}\right)\cos\varphi e^{j(\omega t-k_{z01}z)}$$

Figure 13A:
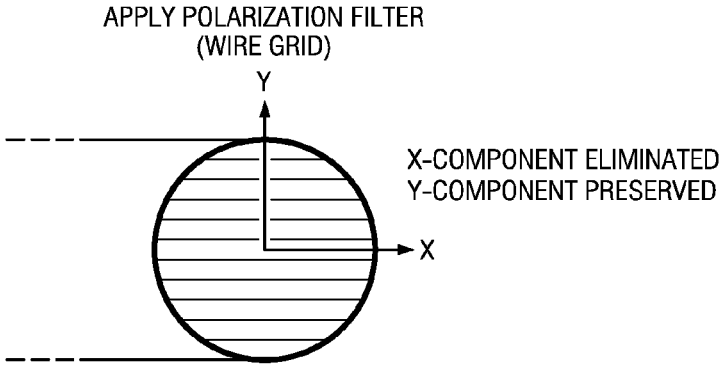
FIGS. 13A and 13B illustrate the orientation and application of a polarization filter with respect to a coordinate system for a $TE_{01}$ waveguide mode in circular waveguide, and an example of the resulting electrical fields situated within such a geometry.

Applying a polarization filter, such as a wire grid depicted in FIG. 13A, to the $TE_{01}$ electric field filters out the $E_x$ component of the $TE_{01}$ electric field and passes the $E_y$ component, such that:

$$E_x \to 0,$$

$$E_y(r,\varphi,z,t) = BJ_1\left(\frac{q_{01}r}{a}\right)\cos\varphi e^{j(\omega t-k_{z01}z)}$$
$$= E_{01}^{\perp}(r,\varphi)e^{j(\omega t-k_{z01}z)}$$

where $$E_{01}^{\perp}(r,\varphi) = BJ_1\left(\frac{q_{01}r}{a}\right)\cos\varphi.$$

Figure 13B:
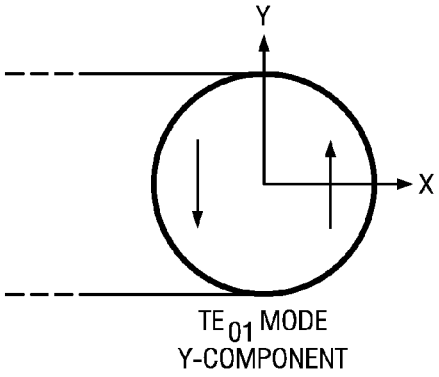

FIG. 13B illustrates the $E_y$ component of the $TE_{01}$ electric field that passes through the polarizer.

Determining a normalization factor for Mode 2 yields:

$$N_{mn} = \int_0^a\int_0^{2\pi}[E_{mn}^{\perp}(r,\varphi)]^2 r\,dr\,d\varphi$$
$$N_{01} = \frac{\pi a^2B^2}{2}J_0^2(q_{01})$$

Therefore, the normalized linear electric field is:

$$U_{mn} = \frac{Ey_{mn}^{\perp}}{\sqrt{N_{mn}}}$$

$$U_{01}(r,\varphi) = \frac{Ey_{01}^{\perp}}{\sqrt{N_{01}}} = \frac{\sqrt{2}}{a\sqrt{\pi}\,J_0(q_{01})}J_1\left(\frac{q_{01}r}{a}\right)\cos\varphi$$

For a normalized polarized linear field of $TE_{01}$ mode in circular waveguide, this can be simplified as:

$$U_{mode2}(r,\varphi) = \frac{\sqrt{2}}{a\sqrt{\pi}\,J_0(q_{01})}J_1\left(\frac{q_{01}r}{a}\right)\cos\varphi.$$

Mode Combining

Figure 14A:
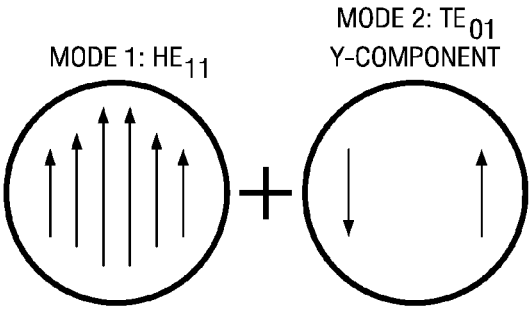
FIGS. 14A and 14B illustrate a cross-sectional view of electric fields of un-mixed $HE_{11}$ and $TE_{01}$ modes and the coordinate system and geometry used in a mathematical description of the beam offset.

FIG. 14A depicts Mode 1 ($HE_{11}$) and Mode 2 (the y-component of $TE_{11}$), which can be combined to offset a beam output of a waveguide.

Recalling that Mode 1 can be expressed by:

$$U_p(r,\varphi) = \frac{1}{a\sqrt{\pi}\,J_1(P_{01})}J_0\left(\frac{P_{01}r}{a}\right)$$

where $P_{01} = 2.405$ and Mode 2 can be expressed by:

$$U_{2p}(r,\varphi) = \frac{\sqrt{2}}{a\sqrt{\pi}\,J_0(q_{01})}J_1\left(\frac{q_{01}r}{a}\right)$$

where $q_{01} = 3.832$

Combining the modes yields:

$$E(x_1,y_1,z_0)=C_1(z_0)U_1(x,y)+C_2(z_0)U_2(x,y)$$

where:

$$C_p(z) = \sqrt{A_p}\,e^{j(k_{z_p}z+\theta_p)},$$

and $C_p$ is complex variable indicating the magnitude and phase of the modes; $A_p$ is percentage of power in mode p; $k_{z_p}$ is the axial wavenumber of mode p; and, $\theta_p$ is phase of mode p.

Waveguide Beam Offset

Figure 14B:
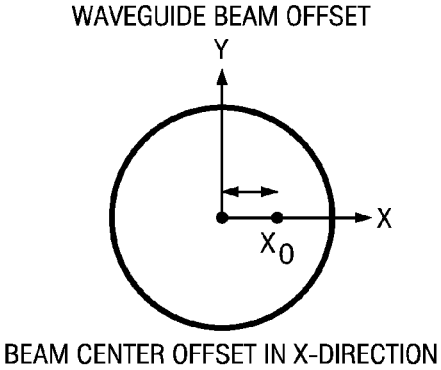

FIG. 14B illustrates the coordinate system and geometry used in a mathematical description of the beam offset in the +x direction along the x-axis. The beam center offset in the x-direction at $z=z_o$ can be given by:

$$x_o(z_o) \equiv \int\int xE^*(x,y,z_o)E(x,y,z_o)\,dx\,dy$$
$$= \int\int xC_1C_2^*U_1U_2^*\,dx\,dy + \int\int xC_1^*C_2^*U_1^*U_2\,dx\,dy$$
$$= 2R_o(C_1C_2^*)b_{12}$$

$$b_{12} \equiv \int\int xU_1U_2\,dx\,dy$$

Converting from polar to Cartesian coordinates (using x=r cos ϕ) yields:

$$b_{12} = \int_o^a \int_o^{2\pi} (r\cos\varphi) U_1 U_2 r dr d\varphi$$
$$= \int_o^a \int_o^{2\pi} U_1 U_2 r^2 \cos\varphi dr d\varphi$$
$$= \int_o^a \int_o^{2\pi} \left[\frac{1}{a\sqrt{\pi}\, J_1(P_{01})} J_o\left(\frac{P_{01} r}{a}\right)\right] \left[\frac{\sqrt{2}}{a\sqrt{\pi}\, J_o(q_{01})} J_1\left(\frac{q_{01} r}{a}\right)\right] r^2 \cos^2\varphi dr d\varphi$$
$$= \frac{\sqrt{2}}{a^{2\pi} J_1(P_{01}) J_o(q_{01})} \int_o^a \int_o^{2\pi} J_o\left(\frac{P_{01} r}{a}\right) J_1 \left(\frac{P_{01} r}{a}\right) r^2 \cos^2\varphi dr d\varphi$$
$$= \frac{\sqrt{2}}{a^2 J_1(P_{01}) J_o(q_{01})} \int_o^a J_o\left(\frac{P_{01} r}{a}\right) J_1\left(\frac{P_{01} r}{a}\right) r^2 dr$$
$$b_{12} = \frac{\sqrt{2}}{a^2 J_1(P_{01}) J_o(q_{01})} \int_o^a J_o\left(\frac{P_{01} r}{a}\right) J_1\left(\frac{P_{01} r}{a}\right) r^2 dr$$

In general:

$$\int x^2 J_o(\alpha x) J_1(\beta x) dx = \frac{2\beta x}{(\alpha^2 - \beta^2)^2} [\beta J_o(\alpha x) J_1(\beta x) - \alpha J_1(\alpha x) J_o(\beta x)] + \frac{x^2}{\alpha^2 - \beta^2} [\beta J_o(\alpha x) J_o(\beta x) + \alpha J_1(\alpha x) J_1(\beta x)]$$

Letting $$\alpha = \frac{P_{01}}{a} \text{ and } \beta = \frac{q_{01}}{a},$$

and since, $J_o(P_{01})=0$ and $J_1(q_{01})=0$, when $P_{01}=2.405$ and $g_{01}=3.832$:

$$b_{12} = \frac{\sqrt{2}}{a^2 J_1(P_{01}) J_o(q_{01})} \left\{ \frac{2 q_{01} a^4}{[P_{01}^2 - q_{01}^2]^2} \left(\frac{-P_{01}}{a}\right) J_1(P_{01}) J_o(q_{01}) \right\}$$
$$= \frac{2\sqrt{2}\, P_{01} q_{01} a}{[P_{01}^2 - q_{01}^2]^2}$$
$$b_{12} = 0.3291a$$

Solving for the waveguide beam offset:

$$x_o(z_0) = 2R_a(C_1 C_2^*) b_{12}$$
$$= (0.6582) R_a (C_1 C_2^*) a$$

where:

$$C_1 = \sqrt{A_1}\, e^{j(k_{z_1} z_o + \theta_1)}$$
$$C_2 = \sqrt{A_2}\, e^{j(k_{z_2} z_o + \theta_2)}$$

-continued $$C_1 C_2^* = \sqrt{A_1 A_2}\, e^{j(k_{z_1} z_o - k_{z_2} z_o + \theta_1 - \theta_2)}$$
$$= \sqrt{A_1 A_2}\, e^{j}(\Delta k_z z_o + \Delta\theta)$$

and $\Delta k_z \equiv k_{z_1} - k_{z_2}$; $\Delta\theta \equiv \Delta\theta_1 - \Delta\theta_2$;

$$k_{z_1} = \sqrt{k^2 - \left(\frac{P_{01}}{a}\right)^2}\,;\ k_{z_2} = \sqrt{k^2 - \left(\frac{q_{01}}{a}\right)^2}\,;$$

$$k = \omega / c;$$

$Re(CC_2^*) = \sqrt{A_1 A_2} \cos[(\Delta k_z) z_0 + \Delta\theta]$. Therefore:

$$x_0(z_0) = 0.6582a\sqrt{A_1 A_2} \cos[(\Delta k_z) z_0 + \Delta\theta]$$

At a fixed propagation distance, set $z_a=0$. Therefore, the waveguide beam offset in the x-direction from the mixing of the $HE_{11}$ mode and $TE_{01}$ mode (y-component) is:

$$x_0(z_a=0) = 0.6582a\sqrt{A_1 A_2} \cos(\Delta\theta)$$

Variable phase shifters can be used to control Δθ and variable attenuators can be used to control either $A_1$ or $A_2$, or both $A_1$ and $A_2$.

While the has the mode mixing has been generally described with respect to waveguide combining, those of skill in the art should recognize that the method is equally applicable to spatial combining. For example, if space is available, multiple waveguide feeds, each supporting different modes, can each be coupled to an antenna; the mode mixing occurring outside the waveguides, i.e., spatial combing of the modes, and where controlling at least one propagation parameter along at least one path can control the mode mixing.

While this invention has been particularly shown and described with references to example embodiments thereof, it will be understood by those skilled in the art that various changes in form and details may be made therein without departing from the scope of the invention encompassed by the appended claims.

Another application in which an example embodiment of beam steering is useful is the high-frequency energy delivery systems for nuclear fusion devices, such as tokomaks. In such devices, magnetically confined plasma is heated using a variety of methods, including electron cyclotron heating, which requires a high-power, high frequency microwave beam. Frequencies, such as 110 GHz, 140 GHz and 170 GHz are typical. Overmoded waveguide structures are used in such systems to guide a high power signal from the source to the plasma.

The radiating beam at the end of a tokomak waveguide transmission line is directed to select locations within the plasma to initiate electron cyclotron heating. In order to direct the beam to the select locations, a mechanically movable mirror can be used at the transmission output end of the waveguide to steer the beam. Such a configuration can be challenging to design due to the presence of high average and high peak microwave (or radio frequency (RF)) power levels. An alternative known method based on mode interference, which offers only a limited amount of beam steering, avoids the use of movable mirrors at the output end of the waveguide, where the highest output levels occur. Rather, a moveable mirror is used at the input of the waveguide to control mode mixing interference.

In applying aspects of the present invention to such an application, the movable mirror can be avoided through use of the separate waveguides of different modes feeding the usual multimode waveguide.

What is claimed is:

1. A method of feeding a radio frequency (RF) antenna comprising:

propagating an RF signal in one or more waveguides, the RF signal propagating in multiple modes;

coupling the one or more waveguides to the antenna; and controlling a propagation characteristic of the respective modes, relative to each other, to steer an electromagnetic beam of the antenna formed from mode mixing of the RF signal.

2. The method as recited in claim 1 wherein the signal is propagating in multiple modes in a common waveguide.

3. The method as recited in claim 1 further comprising:

generating the signal at a transmitter;

splitting the signal to enable propagation of the signal along two or more paths in respective modes;

controlling the propagation characteristic in at least one of the paths; and coupling the two or more paths to the one or more waveguides.

4. The method as recited in claim 1 further comprising:

coupling two or more paths to the one or more waveguides, the two or more paths each enabling the propagation of one or more modes;

controlling the propagation characteristic in at least one of the paths;

combining the two or more paths into a receive signal; and receiving the receive signal at a receiver.

5. The method as recited in claim 1 wherein the propagation characteristic controlled is phase.

6. The method as recited in claim 5 wherein a further propagation characteristic controlled is amplitude.

7. The method as recited in claim 6 wherein a yet further propagation characteristic controlled is polarization.

8. The method as recited in claim 1 wherein the propagation characteristic controlled is amplitude.

9. The method as recited in claim 1 wherein the propagation characteristic controlled is polarization.

10. The method as recited in claim 1 wherein the propagation characteristic controlled is frequency.

11. The method as recited in claim 1 wherein the propagation characteristic controlled is physical orientation.

12. The method as recited in claim 1 wherein the one or more waveguides is comprised of a circular waveguide.

13. The method as recited in claim 12 wherein the one or more waveguides are further comprised of a circular corrugated waveguide.

14. The method as recited in claim 13 wherein a first mode is transverse electric 01 (TE01) mode, and a second mode is hybrid electric 11 (HE11) mode.

15. The method as recited in claim 1 wherein the one or more waveguides is a rectangular waveguide.

16. A method of steering an electromagnetic beam comprising:

propagating a first radio frequency (RF) signal in a first waveguide having a first mode;

propagating a second RF signal in a second waveguide having a second mode;

combining the first RF signal and the second RF signal into an electromagnetic beam; and controlling a propagation parameter of at least one of the RF signals to steer the electromagnetic beam.

17. The method as recited in claim 16 further comprising propagating the first and second RF signals together in a common waveguide, the common waveguide coupled to the antenna, the first and second waveguides, or a combination thereof.

18. The method as recited in claim 16 further comprising:

generating a transmit signal at a transmitter;

splitting the transmit signal into the first and second RF signals;

propagating the first and second RF signals along respective first and second paths and controlling the propagation parameters of at least one of the paths; and coupling the respective first and second paths to the first and second waveguides.

19. The method as recited in claim 16 further comprising:

coupling the first and second waveguides to respective first and second paths and controlling the propagation parameters of at least one of the paths;

combining the first and second paths into a receive signal; and receiving the receive signal at a receiver.

20. The method as recited in claim 16 wherein the propagation parameter controlled is phase.

21. The method as recited in claim 20 wherein a further propagation parameter controlled is amplitude.

22. The method as recited in claim 21 wherein a yet further propagation parameter controlled is polarization.

23. The method as recited in claim 16 wherein the propagation parameter controlled is amplitude.

24. The method as recited in claim 16 wherein the propagation parameter controlled is polarization.

25. The method as recited in claim 16 wherein the propagation parameter controlled is frequency.

26. The method as recited in claim 16 wherein the propagation parameter controlled is physical orientation.

27. The method as recited in claim 17 wherein the common waveguide is circular waveguide.

28. The method as recited in claim 16 wherein the first waveguide is circular waveguide and the second waveguide is circular corrugated waveguide.

29. The method as recited in claim 28 wherein the first mode is transverse electric 01 (TE01) mode, and the second mode is hybrid electric 11 (HE11) mode.

30. The method as recited in claim 16 wherein the first and second waveguides are rectangular waveguides.

31. An antenna feed comprising:

one or more waveguides, for propagating a radio frequency (RF) signal in multiple modes, coupled to an antenna; and a controller, for controlling a propagation characteristic of the respective modes, relative to each other, to steer an electromagnetic beam of the antenna formed from mode mixing of the RF signal.

32. The antenna feed as recited in claim 31 wherein a common waveguide propagates the signal in multiple modes, the common waveguide coupled to the antenna, the one or more waveguides, or a combination thereof.

33. The antenna feed as recited in claim 31 further comprising:

a transmitter for generating a transmit signal;

a splitter/combiner for splitting the transmit signal along a first and second path, the first and second paths respectively coupled to the one or more waveguides, and the controller controlling the propagation characteristic in at least one of the paths.

34. The antenna feed as recited in claim 31 further comprising:

a first path and a second path, respectively coupled to the one or more waveguides, and the controller controlling the propagation characteristic in at least one of the paths;

a splitter/combiner for combining the first and second paths into a receive signal; and a receiver for receiving the receive signal.

35. The antenna feed as recited in claim 31 wherein the propagation characteristic controlled is phase.

36. The antenna feed as recited in claim 35 wherein a further propagation characteristic controlled is amplitude.

37. The antenna feed as recited in claim 36 wherein a yet further propagation characteristic controlled is polarization.

38. The antenna feed as recited in claim 31 wherein the propagation characteristic controlled is amplitude.

39. The antenna feed as recited in claim 31 wherein the propagation characteristic controlled is polarization.

40. The antenna feed as recited in claim 31 wherein the propagation characteristic controlled is frequency.

41. The antenna feed as recited in claim 31 wherein the propagation characteristic controlled is physical orientation.

42. The antenna feed as recited in claim 31 wherein the one or more waveguides is a circular waveguide.

43. The antenna feed as recited in claim 42 wherein the one or more waveguides are further comprised of a circular corrugated waveguide.

44. The antenna feed as recited in claim 43 wherein the first mode is transverse electric 01 (TE01) mode, and the second mode is hybrid electric 11 (HE11) mode.

45. The antenna feed as recited in claim 31 wherein the one or more waveguides is a rectangular waveguide.

46. An apparatus for steering an electromagnetic beam comprising:

a first waveguide for propagating a first radio frequency (RF) signal having a first mode;

a second waveguide for propagating a second RF signal having a second mode; and a controller for controlling a propagation parameter of at least one of the RF signals to steer the electromagnetic beam formed from mode mixing of the first RF signal and the second RF signal.

47. The apparatus as recited in claim 46 further comprising:

an antenna, wherein steering the electromagnetic beam includes steering the electromagnetic beam of the antenna; and a common waveguide for propagating the first and second RF signals together, the common waveguide coupled to the antenna, the first and second waveguides, or a combination thereof.

48. The apparatus as recited in claim 46 further comprising:

a transmitter for generating a transmit signal;

a splitter/combiner for splitting the transmit signal into the first and second RF signals; and a first and second path, respectively coupled to the first and second waveguides, the controller controlling the propagation parameter of at least one of the paths.

49. The apparatus as recited in claim 46 further comprising:

a first and second path, respectively coupled to the first and second waveguides, the controller controlling the propagation parameter of at least one of the paths;

a splitter/combiner for combining the first and second signals into a receive signal; and a receiver to receive the receive signal.

50. The apparatus as recited in claim 46 wherein the propagation parameter controlled is phase.

51. The apparatus as recited in claim 50 wherein the propagation parameter controlled is amplitude.

52. The apparatus as recited in claim 51 wherein the propagation parameter controlled is polarization.

53. The apparatus as recited in claim 46 wherein the propagation parameter controlled is amplitude.

54. The apparatus as recited in claim 46 wherein the propagation parameter controlled is polarization.

55. The apparatus as recited in claim 46 wherein the propagation parameter controlled is frequency.

56. The apparatus as recited in claim 46 wherein the propagation parameter controlled is physical orientation.

57. The apparatus as recited in claim 47 wherein the common waveguide is a circular waveguide.

58. The apparatus as recited in claim 46 wherein the first waveguide is a circular waveguide and the second waveguide is a circular corrugated waveguide.

59. The apparatus as recited in claim 58 wherein the first mode is transverse electric 01 (TE01) mode, and the second mode is hybrid electric (HE11) mode.

60. The apparatus as recited in claim 46 wherein the first and second waveguides are rectangular waveguides.

* * * * *